US010986705B2

(12) United States Patent
Nikishov et al.

(10) Patent No.: US 10,986,705 B2
(45) Date of Patent: Apr. 20, 2021

(54) MICROWAVE OVEN

(71) Applicant: SAMSUNG ELECTRONICS CO., LTD., Suwon-si (KR)

(72) Inventors: Artem Yurievich Nikishov, Kolomna (RU); Alexander Nikolayevich Khripkov, Lobnya (RU); Elena Alexandrovna Shepeleva, Komsomolskaya (RU)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 346 days.

(21) Appl. No.: 15/410,212

(22) Filed: Jan. 19, 2017

(65) Prior Publication Data

US 2017/0257914 A1 Sep. 7, 2017

(30) Foreign Application Priority Data

Mar. 1, 2016 (RU) ..... RU2016107376
Dec. 2, 2016 (KR) ..... 10-2016-0163264

(51) Int. Cl.

| | |
|---|---|
| ***H05B 6/72*** | (2006.01) |
| ***H05B 6/64*** | (2006.01) |
| ***H05B 6/74*** | (2006.01) |
| ***H05B 6/78*** | (2006.01) |

(52) U.S. Cl.

CPC ..... *H05B 6/725* (2013.01); *H05B 6/72* (2013.01); *H05B 6/782* (2013.01)

(58) Field of Classification Search

CPC ..... H05B 6/72; H05B 6/782; H05B 6/725; H05B 6/74

USPC ..... 219/748, 754, 763, 745, 756, 757, 681, 219/682, 683, 685, 400, 563, 710, 720, 219/702; 126/21 A; 108/20, 136

See application file for complete search history.

(56) References Cited

U.S. PATENT DOCUMENTS 3,366,769 A * 1/1968 Lima ..... A23L 3/365 219/748
3,461,260 A * 8/1969 Bremer ..... H05B 6/6426 219/745

(Continued)

FOREIGN PATENT DOCUMENTS

EP 0274164 7/1988
EP 2230464 A1 9/2010

(Continued)

OTHER PUBLICATIONS

Form PCT/ISA/210; International Search Report dated May 23, 2017 in related PCT Application No. PCT/KR2017/002209.

(Continued)

*Primary Examiner* — Quang T Van
(74) *Attorney, Agent, or Firm* — Staas & Halsey LLP

(57) ABSTRACT

Disclosed herein is a microwave oven having an improved structure with which foods can be effectively heated. The microwave oven includes: a housing including a cooking chamber having a bottom surface; at least one first reflective portion formed on the bottom surface of the cooking chamber; a magnetron provided to generate microwave radiation; and a tray disposed apart from the bottom surface of the cooking chamber and supporting food to be heated. The at least one first reflective portion extends a given height (h) above a reference level (RL).

20 Claims, 41 Drawing Sheets

(56) References Cited

U.S. PATENT DOCUMENTS

| | | | | |
|---|---|---|---|---|
| 4,036,151 | A * | 7/1977 | Shin | A47J 37/046 108/136 |
| 4,615,405 | A * | 10/1986 | Morino | A47J 37/046 177/144 |
| 4,683,362 | A | 7/1987 | Yangas | |
| 4,808,781 | A * | 2/1989 | Liu | H05B 6/6411 108/20 |
| 5,237,139 | A | 8/1993 | Berg et al. | |
| 5,828,042 | A | 10/1998 | Choi et al. | |
| 5,877,479 | A | 3/1999 | Yu | |
| 8,987,644 | B2 | 3/2015 | Mori et al. | |
| 2003/0136779 | A1 | 7/2003 | Lee | |
| 2009/0139988 | A1 | 6/2009 | Farnworth | |
| 2009/0206071 | A1 | 8/2009 | Mori et al. | |
| 2013/0213956 | A1 * | 8/2013 | Sorin | H05B 6/74 219/756 |
| 2014/0263293 | A1 | 9/2014 | Eisenhart | |

FOREIGN PATENT DOCUMENTS

| | | |
|---|---|---|
| GB | 2183980 | 6/1987 |
| GB | 2244193 | 11/1991 |
| JP | 5-66019 | 3/1993 |
| JP | 2002-327983 | 11/2002 |
| KR | 1998-0008951 | 4/1998 |
| KR | 10-2005-0036439 | 4/2005 |

OTHER PUBLICATIONS

Extended European Search Report dated Nov. 20, 2018 in European Patent Application No. 17760296.8.

European Communication dated Mar. 29, 2019 in European Patent Application No. 17760296.8.

Chinese Office Action dated May 28, 2020 in Chinese Patent Application No. 201870004503.8.

* cited by examiner

MICROWAVE OVEN

CROSS-REFERENCE TO RELATED APPLICATIONS

This application claims the benefit of Russian Application No. RU2016107376, filed Mar. 1, 2016, in the Russian Intellectual Property Office and Korean Application No. 10-2016-0163264 filed Dec. 2, 2016 in the Korean Intellectual Property Office, the disclosures of which are incorporated herein by reference.

BACKGROUND

1. Field

Embodiments of the present invention relate generally to a microwave oven, and more particularly a microwave oven having an improved structure with which foods can be effectively heated.

2. Description of the Related Art

Microwave ovens are cookware heating foods using a property of electromagnetic radiation called microwaves. Microwave ovens generate heat from the inside of food to heat the food through dielectric heating.

When electromagnetic radiation having a high frequency penetrates into the food, it induces water polar molecules inside the food to rotate, and it produces thermal energy. Food is heated in the microwave ovens due to consumption of this energy.

Quality of food cooked by a microwave oven is determined according to how even temperature distribution inside the food is. To even the temperature distribution inside the food, the microwaves should be evenly applied to the entirety of the food.

Therefore, studies of methods by which microwaves can be evenly applied to food are actively in progress.

SUMMARY

Therefore, it is an aspect of the present invention to provide a microwave oven with an improved structure through which foods can be heated evenly.

It is another aspect of the present invention to provide a microwave oven with an improved structure through which cooking times can be reduced.

Additional aspects of the invention will be set forth in part in the description which follows and, in part, will be obvious from the description, or may be learned by practice of the invention.

In accordance with an aspect of the present invention, a microwave oven includes: a housing including a cooking chamber having a bottom surface; at least one first reflective portion formed on the bottom surface of the cooking chamber; a magnetron provided to generate microwave radiation; and a tray disposed apart from the bottom surface of the cooking chamber and supporting food to be heated. The at least one first reflective portion extends a given height (h) above a reference level (RL).

A distance between the tray and a highest point of the at least one first reflective portion may be smaller than $\lambda/4$ where $\lambda$ is a minimum wavelength of the microwave radiation.

A height (h) of the at least one first reflective portion may be smaller than $\lambda/4$, and a cross-sectional area (s) of the at least one first reflective portion may be smaller than $h\times\lambda/4$.

The at least one first reflective portion may be integrally formed with the bottom surface of the cooking chamber.

A height (h) and/or a width (w) of the at least one first reflective portion may be changed depending on a method of operating the microwave oven according to a weight, a type, and an initial state of the food.

The height (h) and/or the width (w) of the at least one first reflective portion may be automatically changed by an elastic body in correspondence with the weight of the food.

The height (h) and/or the width (w) of the at least one first reflective portion may be mechanically changed according to manual selection by a user.

A distance between the tray and the bottom surface of the cooking chamber may be automatically changed by a spring damper in correspondence with a weight of the food.

A distance between the tray and the bottom surface of the cooking chamber may be changed according to manual selection by a user.

The at least one first reflective portion may be used as a guide for wheels that support the tray and rotate about a rotational axis of the tray which passes through a geometrical center of the bottom surface of the cooking chamber.

The at least one first reflective portion may have a closed loop shape, and may have a symmetrical structure with respect to a plane including a rotational axis (X) of the tray which passes through a geometrical center (O) of the bottom surface of the cooking chamber.

The at least one first reflective portion may have a structure of rotational symmetry with respect to a plane including a rotational axis (X) of the tray which passes through a geometrical center (O) of the bottom surface of the cooking chamber.

The at least one first reflective portion may have a structure of mirror symmetry with respect to a plane including a rotational axis (X) of the tray which passes through a geometrical center (O) of the bottom surface of the cooking chamber.

The at least one first reflective portion may have a plurality of symmetrical structures.

The at least one first reflective portion may have an asymmetrical structure.

The tray may be disposed apart from the bottom surface of the cooking chamber, and be rotatably provided.

A part of the bottom surface of the cooking chamber including the at least one first reflective portion may be provided to be rotatable about a vertical axis (Y) passing through a geometrical center (O) of the bottom surface of the cooking chamber.

The food may be supported by a non-rotating tray formed of an insulating material.

In accordance with another aspect of the present invention, a microwave oven includes: a housing including a cooking chamber having a bottom surface; at least one second reflective portion formed on the bottom surface of the cooking chamber; a magnetron provided to generate microwave radiation; and a tray disposed apart from the bottom surface of the cooking chamber and supporting food to be heated. The at least one second reflective portion is recessed a given depth (d) below a reference level (RL).

A distance between the tray and a highest point of the bottom surface of the cooking chamber may be smaller than $\lambda/4$ where $\lambda$ is a minimum wavelength of the microwave radiation.

A depth (d) of the at least one second reflective portion may be smaller than $\lambda/4$, and a cross-sectional area (s) of the at least one second reflective portion may be smaller than $d\times\lambda/4$.

The at least one second reflective portion may be integrally formed with the bottom surface of the cooking chamber.

A depth (d) and/or a width (w) of the at least one second reflective portion may be changed depending on a method of operating the microwave oven according to a weight, a type, and an initial state of the food.

The depth (d) and/or the width (w) of the at least one second reflective portion may be automatically changed by an elastic body in correspondence with the weight of the food.

The depth (d) and/or the width (w) of the at least one second reflective portion may be mechanically changed according to manual selection by a user.

A distance between the tray and the bottom surface of the cooking chamber may be automatically changed by a spring damper in correspondence with a weight of the food.

A distance between the tray and the bottom surface of the cooking chamber may be changed according to manual selection by a user.

The at least one second reflective portion may be used as a guide for wheels that support the tray and rotate about a rotational axis (X) of the tray which passes through a geometrical center (O) of the bottom surface of the cooking chamber.

The at least one second reflective portion may have a closed loop shape, and may have a symmetrical structure with respect to a plane including a rotational axis (X) of the tray which passes through a geometrical center (O) of the bottom surface of the cooking chamber.

The at least one second reflective portion may have a structure of rotational symmetry with respect to a plane including a rotational axis (X) of the tray which passes through a geometrical center (O) of the bottom surface of the cooking chamber.

The at least one second reflective portion may have a structure of mirror symmetry with respect to a plane including a rotational axis (X) of the tray which passes through a geometrical center (O) of the bottom surface of the cooking chamber.

The at least one second reflective portion may have a plurality of symmetrical structures.

The at least one second reflective portion may have an asymmetrical structure.

The tray may be disposed apart from the bottom surface of the cooking chamber, and be rotatably provided.

A part of the bottom surface of the cooking chamber including the at least one second reflective portion may be provided to be rotatable about a vertical axis (Y) passing through a geometrical center (O) of the bottom surface of the cooking chamber.

The food may be supported by a non-rotating tray formed of an insulating material.

BRIEF DESCRIPTION OF THE DRAWINGS

These and/or other aspects of the invention will become apparent and more readily appreciated from the following description of the embodiments, taken in conjunction with the accompanying drawings of which:

FIGS. 10A to 100 are views illustrating a process in which a variable pattern according to a tenth embodiment is operated in the microwave oven according to the embodiment of the present invention;

DETAILED DESCRIPTION

Figure 1:
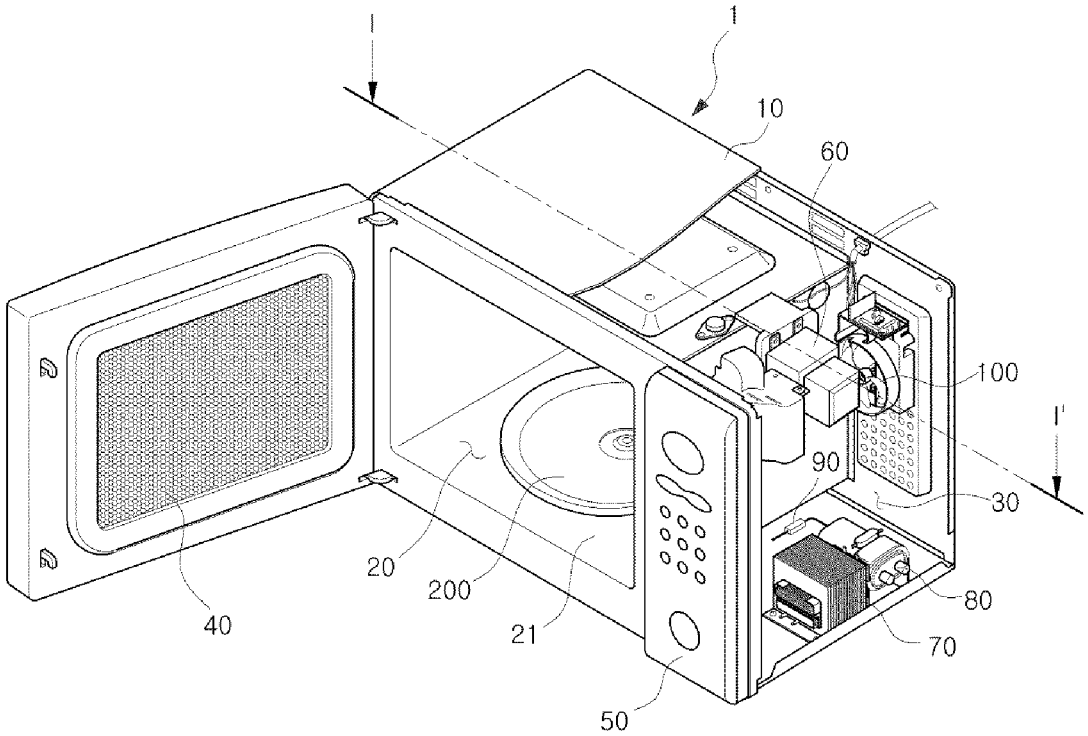
FIG. 1 is a perspective view illustrating an exterior of the microwave oven according to an embodiment of the present invention.

Reference will now be made in detail to embodiments of the present invention, examples of which are illustrated in the accompanying drawings, wherein like reference numerals refer to like elements throughout. Meanwhile, terms such as "front end," "rear end," "upper portion," "lower portion," "upper end," "lower end," etc. used in the following description are defined based on the drawings, and the shapes and positions of elements are not limited by these terms.

Quality of food cooked by a microwave oven can be dependent on how even temperature distribution inside the food undergoing a cooking process is. In general, users are more satisfied with the results of cooking food using a microwave oven when temperature deviation inside the food undergoing the cooking process is smaller.

To even the temperature distribution inside the food, electromagnetic field distribution inside the food should be evened.

A main problem of the microwave oven is that the food is unevenly heated due to uneven electromagnetic field distribution inside the food. When the microwave oven is operated, specific electromagnetic field distribution is formed in a cooking chamber of the microwave oven. At this time, a region in which a degree of the electromagnetic field distribution is high and a region in which the degree of the electromagnetic field distribution is low may be formed in the food, which is responsible for uneven heating of the food.

In general, food can be evenly heated by forming an even electromagnetic field in the entire cooking chamber.

As an example, when a plurality of protrusions are formed on an inner surface of the cooking chamber, there are no depressions capable of collecting microwave radiation on the inner surface of the cooking chamber, and thus the microwave radiation can be effectively dispersed throughout the cooking chamber. However, when food to be cooked is introduced into the cooking chamber, the food introduced into the cooking chamber changes the even electromagnetic field distribution to some extent. This can be compensated for by a change in operating frequency of a magnetron. Consequently, simply forming the plurality of protrusions on the inner surface of the cooking chamber is not necessarily sufficient for forming the even electromagnetic field throughout the cooking chamber.

Hereinafter, a method for effectively forming an even electromagnetic field throughout the cooking chamber, that is, a method for evenly heating food, will be described.

Figure 2:
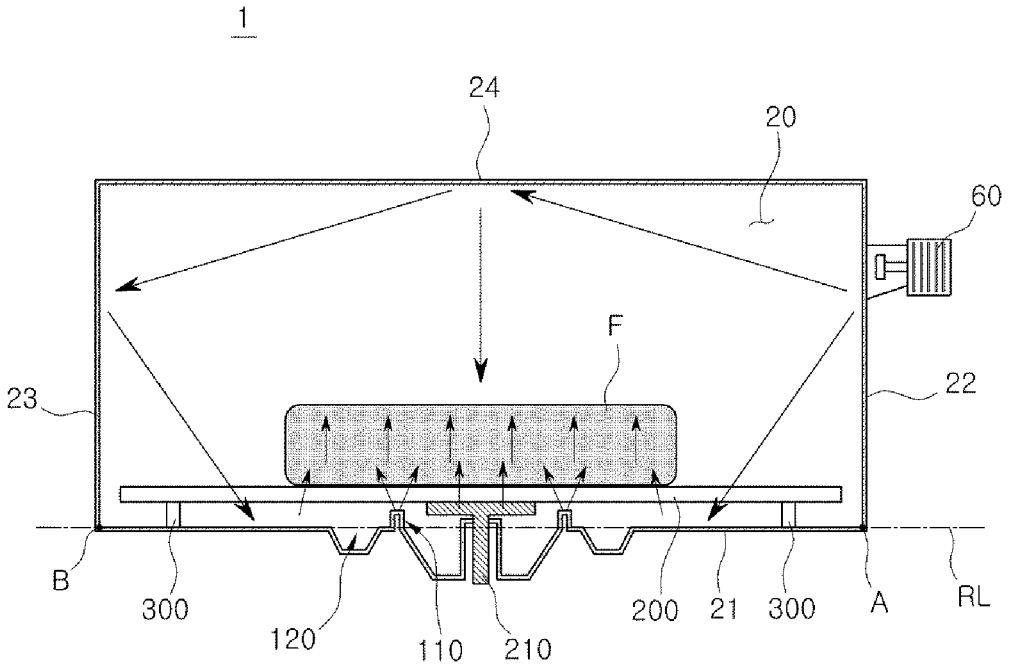
FIG. 2 is a view schematically illustrating a process in which food is heated by microwave radiation when the microwave oven according to the embodiment of the present invention is operated.
Figure 3A:
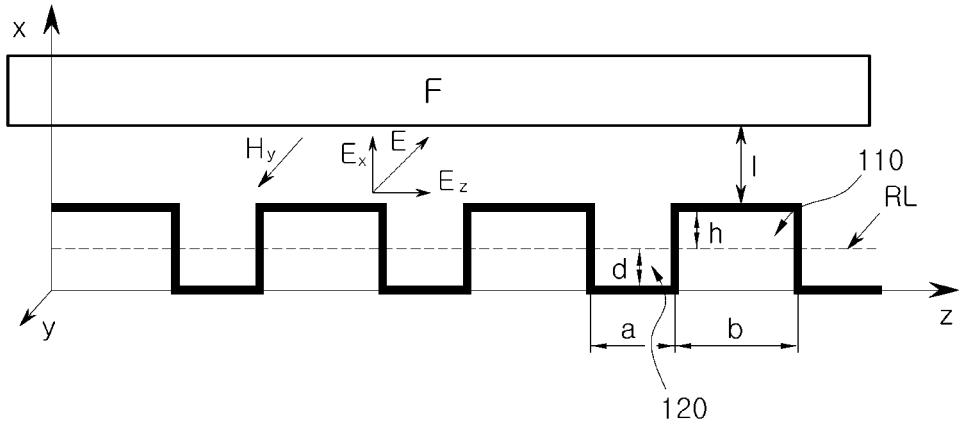
FIGS. 3A and 3B are views for theoretically describing a shape of a pattern formed on a bottom of a cooking chamber in the microwave oven according to the embodiment of the present invention.
Figure 3B:
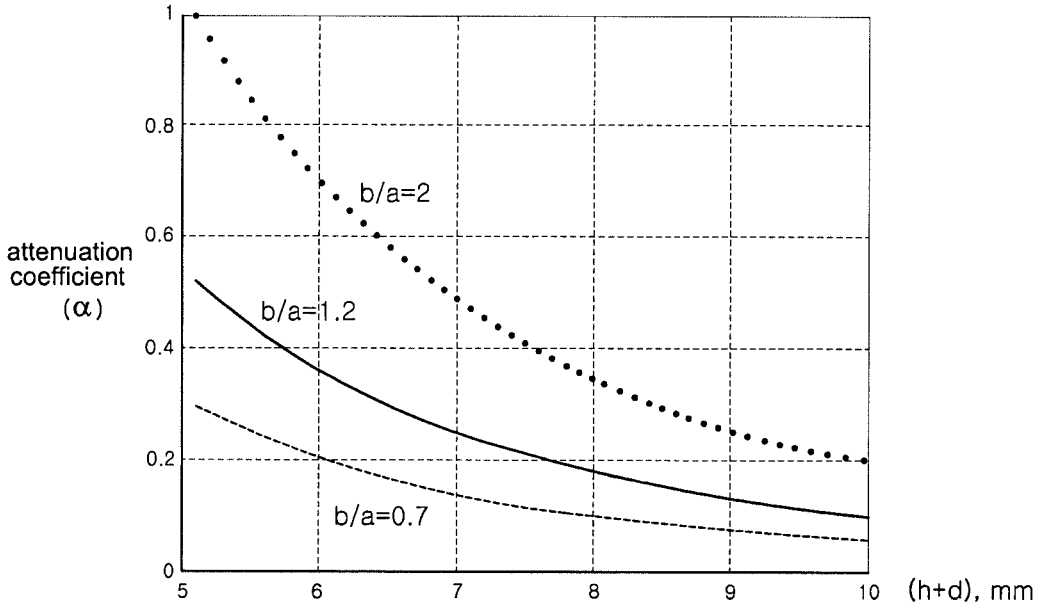

FIG. 1 is a perspective view illustrating an exterior of the microwave oven according to an embodiment of the present invention. FIG. 2 is a view schematically illustrating a process in which food is heated by microwave radiation when the microwave oven according to the embodiment of the present invention is operated. FIGS. 3A and 3B are views for theoretically describing a shape of a pattern formed on a bottom of a cooking chamber in the microwave oven according to the embodiment of the present invention. Hereinafter, the food is denoted by a symbol "F."

As illustrated in FIGS. 1 and 2, the microwave oven 1 may include a housing 10 forming an exterior. A cooking chamber 20 whose front surface is open to enable foods to be put therein, and an electrical component compartment 30 in which various electrical components are installed may be provided in the housing 10.

The cooking chamber 20 may include a bottom surface 21, a first lateral surface 22 adjacent to the electrical component compartment 30, a second lateral surface 23 facing the first lateral surface 22, a top surface 24 facing the bottom surface 21, and a rear surface (not illustrated) facing the open front surface. Various types of patterns may be formed on the bottom surface 21 of the cooking chamber 20. The patterns will be described below in detail.

A tray 200 on which food to be cooked is put may be installed in the cooking chamber 20. The tray 200 may be disposed apart from the bottom surface 21 of the cooking chamber 20. The tray 200 may be rotatably installed in the cooking chamber 20. The tray 200 can be rotated by a rotating unit 210 such that the food put on the tray 200 can be evenly heated by microwave radiation. The rotating unit 210 may include a tray motor (not illustrated) generating a rotation driving force for rotating the tray 200, and the tray motor may be provided below the cooking chamber 20. The tray 200 may be balanced and rotated by a plurality of wheels 300. In other words, the plurality of wheels 300 serve to rotatably support the tray 200.

A door 40 whose one side is hinged so that the cooking chamber 20 can be opened and closed may be installed in the front of the housing 10. Further, a control panel 50 that is located in front of the electrical component compartment 30 and for operation of various electrical components in the electrical component compartment 30 may be installed in the front of the housing 10.

A magnetron 60 generating the microwave radiation to be radiated into the cooking chamber 20, and a high-voltage transformer 70, a high-voltage capacitor 80, a high-voltage diode 90, etc. constituting a drive circuit for driving the magnetron 60 may be installed in the electrical component compartment 30. A cooling fan 95 for suctioning open air to cool the various electrical components in the electrical component compartment 30 may be installed behind the electrical component compartment 30.

The microwave oven 1 is operated as follows. When food is put in the cooking chamber 20 and the microwave oven 1 is operated through the control panel 50, power supply is applied to the high-voltage transformer 70 and is boosted by the high-voltage transformer 70. The power supply is again doubled by the high-voltage capacitor 80 and the high-voltage diode 90, and is transmitted to the magnetron 60. The magnetron 60 receives the high voltage, and generates microwave radiation to radiate it into the cooking chamber 20. The food is cooked in the cooking chamber 20 by the microwave radiation.

Meanwhile, when the microwave oven 1 is operated, the cooling fan 100 for cooling heat generated by the magnetron 60 or the high-voltage transformer 70 is operated, and thereby a flow of air circulating open air into the electrical component compartment 30 occurs.

To evenly heat the food located in the cooking chamber 20, even transmission of the microwave radiation to the food is necessary. The microwave radiation radiated from the magnetron 60 into the cooking chamber 20 may be directly transmitted to the food or transmitted to the food via an inner wall of the cooking chamber 20. As illustrated in FIG. 2, since most of the microwave radiation is transmitted to the food via the inner wall of the cooking chamber 20, a state of the inner wall of the cooking chamber 20 can exert a great influence on the transmission of the microwave radiation to the food. Especially, since the bottom surface 21 of the cooking chamber 20 is closest to the food to be cooked, it exerts the greatest influence on the transmission of the microwave radiation to the food. That is, distribution of the microwave radiation transmitted to the food may be dependent on the state of the bottom surface 21 of the cooking chamber 20.

A pattern may be formed on the bottom surface 21 of the cooking chamber 20 such that the microwave radiation reflected from the bottom surface 21 of the cooking chamber 20 can be evenly transmitted to the food.

The pattern may be integrally formed with the bottom surface 21 of the cooking chamber 20. In detail, at least one of at least one first reflective portion 110 and at least one second reflective portion 120 may be integrally formed with the bottom surface 21 of the cooking chamber 20.

The pattern may be formed on the bottom surface 21 of the cooking chamber 20 by at least one of stamping, mold casting, and milling.

The pattern may include at least one of the first reflective portion 110 and the second reflective portion 120. In other words, the pattern may include at least one of the at least one first reflective portion 110 and the at least one second reflective portion 120. The first reflective portion 110 may have a shape protruding above a reference level RL from the bottom surface 21 of the cooking chamber 20. That is, the first reflective portion 110 may have a shape extending a given height h above the reference level RL from the bottom surface 21 of the cooking chamber 20. In another aspect, the first reflective portion 110 may be closer to the tray 200 than the second reflective portion 120. Thus, the first reflective portion 110 can transmit a relatively large quantity of a heating source, i.e., microwave radiation, to the food because it is close to the food on the tray 200. The first reflective portion 110 may include an uneven shape. As will be described below, the first reflective portion 110 may include an uneven shape having a plurality of regions. The second reflective portion 120 may have a shape recessed from the bottom surface 21 of the cooking chamber 20 below the reference level RL. That is, the second reflective portion 120 may have a shape recessed a given depth d below the reference level RL from the bottom surface 21 of the cooking chamber 20. In another aspect, the second reflective portion 120 may be farther from the tray 200 than the first reflective portion 110. Therefore, the second reflective portion 120 can transmit a relatively small quantity of the heating source, i.e., microwave radiation, to the food because it is far from the food on the tray 200. The second reflective portion 120 may include an uneven shape. As will be described below, the second reflective portion 120 may include an uneven shape having a plurality of regions. The bottom surface 21 of the cooking chamber 20 may be a flat surface forming the bottom of the cooking chamber 20. The reference level RL refers to an imaginary surface including the bottom surface 21 and a surface extending from the bottom surface 21 in a horizontal direction. In another aspect, the reference level RL refers to an imaginary flat surface including boundaries at which the bottom surface 21 of the cooking chamber 20 meets opposite lateral surfaces of the cooking chamber 20. The reference level RL may be shown in a planar form in which a first boundary A at which the bottom surface 21 of the cooking chamber 20 meets the first lateral surface 22 of the cooking chamber 20 and a second boundary B at which the bottom surface 21 of the cooking chamber 20 meets the second lateral surface 23 of the cooking chamber 20 are connected in a two-dimensional lateral surface. At least one of the first reflective portion 110 and the second reflective portion 120 is formed on the bottom surface 21 of the cooking chamber 20, and thereby the distribution of the microwave radiation transmitted from the bottom surface 21 of the cooking chamber 20 to the food can be adjusted. To be specific, the first reflective portion 110 reduces a distance between the food and the bottom surface 21 of the cooking chamber 20 to enable an intensity of the microwave radiation transmitted to the food to be increased. Further, the second reflective portion 120 increases the distance between the food and the bottom surface 21 of the cooking chamber 20 to enable the intensity of the microwave radiation transmitted to the food to be reduced. In this way, the pattern formed on the bottom surface 21 of the cooking chamber 20 can serve as one factor exerting an important influence on the even heating of the food caused by the microwave radiation.

The height h of the first reflective portion 110, the depth d of the second reflective portion 120, and cross-sectional areas s of the first and second reflective portions 110 and 120 can be defined in relation to a minimum wavelength λ of the microwave radiation generated by the magnetron 60. To be specific, the height h of the first reflective portion 110 and the depth d of the second reflective portion 120 may be smaller than λ/4. Further, the cross-sectional area S of the second reflective portion 120 may be smaller than d×λ/4. In addition, the cross-sectional area s of the first reflective portion 110 may be smaller than h×λ/4. Hereinafter, a theoretical background of relations between the height h of the first reflective portion 110, the depth d of the second reflective portion 120, a width a of the second reflective portion 120, and a width b of the first reflective portion 110 will be described in detail. A density p of the microwave radiation which the food absorbs at all the points of the food can be defined by the Joule-Lenz law. The Joule-Lenz law is as follows.

$$p=\vec{J}\vec{E}=\vec{J}^2/\sigma \qquad \text{[Formula 1]}$$

In Formula 1, $\vec{J}$ indicates a current density of the bottom surface 21 of the cooking chamber 20, $\vec{E}$ indicates an electric field density at a specified point of the food, and I? indicates a conductivity of a material of which the bottom surface 21 of the cooking chamber 20 is formed.

An induced electric surface current $J_s$ can be defined as in Formula 2 below according to boundary conditions of the bottom surface 21 of the cooking chamber 20.

$$J_s=H_{y2}-H_{y1}=\Delta H_y \quad \text{[Formula 2]}$$

In Formula 2, $\vec{H}_y$ indicates a tangential component of magnetic field density. Therefore, the density p of the microwave radiation which the food absorbs at all the points of the food can be defined as in Formula 3 below.

$$p=\Delta H_y^2/\sigma \quad \text{[Formula 3]}$$

FIG. 3A illustrates an example of the pattern formed on the bottom surface 21 of the cooking chamber 20. In FIG. 3A, "RL" indicates the reference level. A tangential component of magnetic field density between the bottom surface 21 of the cooking chamber 20 and the food can be defined as in Formula 4 according to the height h of the first reflective portion 110, the depth d of the second reflective portion 120, the width a of the second reflective portion 120, and the width b of the first reflective portion 110.

$$E_z=\frac{a}{a+b}A\sin\left(\frac{2\pi}{\lambda_0}(h+d)\right),\ H_y=-j\frac{1}{Z_0}A\cos\left(\frac{2\pi}{\lambda_0}(h+d)\right). \quad \text{[Formula 4]}$$

Thus, surface waves between the bottom surface 21 of the cooking chamber 20 and the food may have a tangential component defined by the bottom surface 21 of the cooking chamber 20. The tangential component is as in Formula 5 below.

$$H_y=-j\frac{2\pi f\varepsilon_0}{\alpha}Be^{-\alpha x}e^{-j\beta z} \quad \text{[Formula 5]}$$

In Formula 5, α indicates an orthogonal power absorption attenuation coefficient. α can be defined as in Formula 6 below.

$$\alpha=\frac{2\pi}{\lambda_0}\frac{a}{a+b}\tan\left(\frac{2\pi}{\lambda_0}(h+d)\right) \quad \text{[Formula 6]}$$

Thus, the density p of the microwave radiation absorbed by the food can be changed at all the points of the food by changing an absorption attenuation coefficient at a specified point of the bottom surface 21 of the cooking chamber 20.

The attenuation coefficient α having an effective influence (changing 10% or more of power) on the electromagnetic field can have a relationship of "0.05<α<1" as illustrated in FIG. 3B. For reference, the transverse axis in FIG. 3B denotes a sum of the height h of the first reflective portion 110 and the depth d of the second reflective portion 120. The sum of the height h of the first reflective portion 110 and the depth d of the second reflective portion 120 can be expressed in units of "mm." The longitudinal axis in FIG. 3B denotes the attenuation coefficient α. An optimum relationship between the height h of the first reflective portion 110, the depth d of the second reflective portion 120, the width a of the second reflective portion 120, and the width b of the first reflective portion 110 can be defined as in Formula 7 below. λ denotes the minimum wavelength of the microwave radiation.

$$(\lambda/16<(h+d)<\lambda/8) \text{ and } (0.5<b/a<2) \quad \text{[Formula 7]}$$

A degree of the density p of the microwave radiation absorbed by the food can be defined according to a distance I from the food. When the vertical distance I between the first reflective portion 110 and the food increases, an influence of the bottom surface 21 of the cooking chamber 20 on the temperature distribution inside the food is reduced. Therefore, a most favorable relation is "(h+d+l)<λ/4."

In this way, at least one of the first reflective portion 110 having various heights h and the second reflective portion 120 having various depths d is applied to the bottom surface 21 of the cooking chamber 20. Thereby, it is possible to evenly heat the food.

Figure 4A:
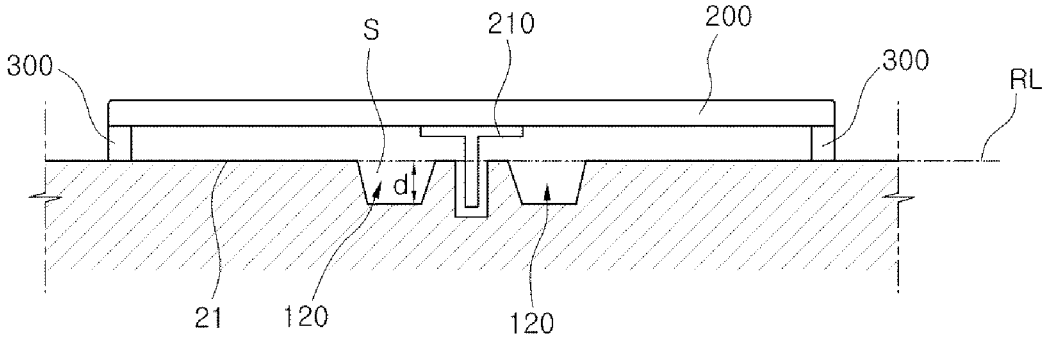
FIG. 4A is a sectional view illustrating a first bottom surface of the cooking chamber in the microwave oven according to the embodiment of the present invention.
Figure 4B:
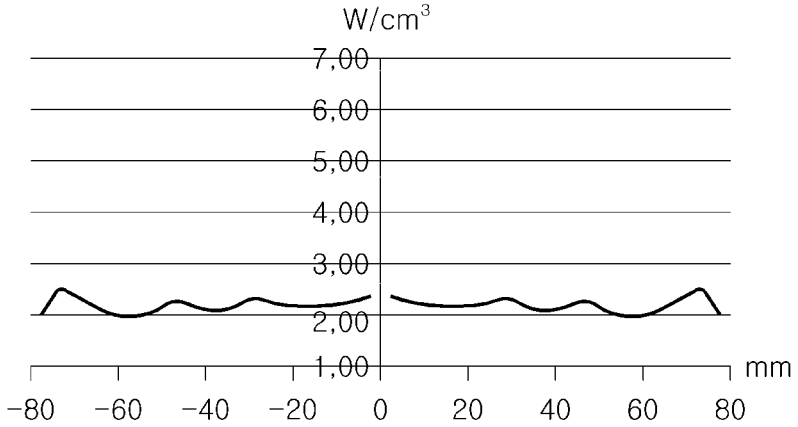
FIG. 4B is a graph illustrating a degree to which the food cooked in the cooking chamber to which the first bottom surface of FIG. 4A is applied is heated.

FIG. 4A is a sectional view illustrating a first bottom surface of the cooking chamber in the microwave oven according to the embodiment of the present invention, and FIG. 4B is a graph illustrating a degree to which the food cooked in the cooking chamber to which the first bottom surface of FIG. 4A is applied is heated. The transverse axis of the graph illustrated in FIG. 4B denotes a width (mm) from the center of the food, and the longitudinal axis denotes a density p (W/cm$^3$) of the microwave radiation absorbed by the food.

As illustrated in FIGS. 4A and 4B, when the second reflective portion 120 is formed in the bottom surface 21 of the cooking chamber 20, the food can be almost evenly heated by the microwave radiation. At this time, the depth d of the second reflective portion 120 may be smaller than λ/4. Further, a cross-sectional area s of the second reflective portion 120 may be smaller than d×λ/4.

The graph of FIG. 4B is based on results derived under conditions in which the frequency of the microwave radiation is 2.45 GHz, the minimum wavelength A of the microwave radiation is about 12 cm, λ/4 is about 3 cm, the depth d of the second reflective portion 120 is 1 cm, and the cross-sectional area s of the second reflective portion 120 is 2 cm$^2$.

The description of FIGS. 4A and 4B is focused on the case in which only the second reflective portion 120 is formed in the bottom surface 21 of the cooking chamber 20. However, a tendency of the graph as illustrated in FIG. 4B can be obtained when at least one of the first and second reflective portions 110 and 120 is formed at the bottom surface 21 of the cooking chamber 20. In detail, even when at least one of the first and second reflective portions 110 and 120 is formed at the bottom surface 21 of the cooking chamber 20, the food can be almost evenly heated by the microwave radiation. In this case, the height h of the first reflective portion 110 may be smaller than λ/4, and the cross-sectional area s of the first reflective portion 110 may be smaller than h×λ/4. Further, the depth d of the second reflective portion 120 may be smaller than λ/4, and the cross-sectional area s of the second reflective portion 120 may be smaller than d×λ/4.

Figure 4C:
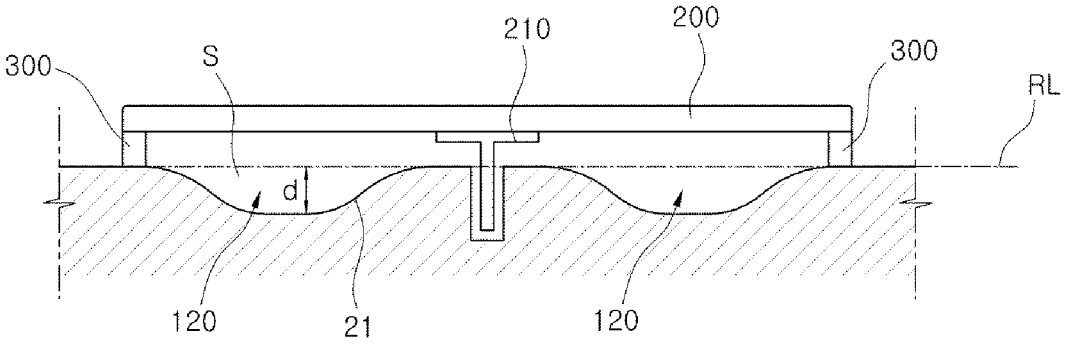
FIG. 4C is a sectional view illustrating a second bottom surface of the cooking chamber in the microwave oven according to the embodiment of the present invention.
Figure 4D:
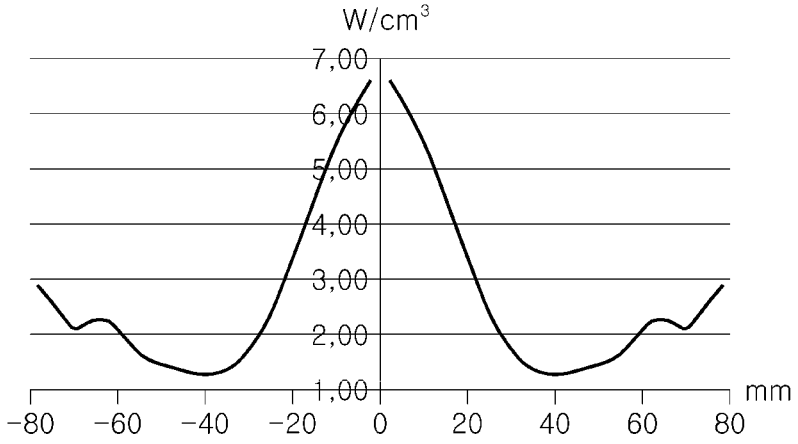
FIG. 4D is a graph illustrating a degree to which the food cooked in the cooking chamber to which the second bottom surface of FIG. 4C is applied is heated.

FIG. 4C is a sectional view illustrating a second bottom surface of the cooking chamber in the microwave oven according to the embodiment of the present invention, and FIG. 4D is a graph illustrating a degree to which the food cooked in the cooking chamber to which the second bottom surface of FIG. 4C is applied is heated. The transverse axis of the graph illustrated in FIG. 4D denotes a width (mm) from the center of the food, and the longitudinal axis denotes a density p (W/cm$^3$) of the microwave radiation absorbed by the food.

As illustrated in FIGS. 4C and 4D, when the second reflective portion 120 is formed in the bottom surface 21 of the cooking chamber 20, the food may be unevenly heated by the microwave radiation. At this time, the depth d of the second reflective portion 120 may be smaller than λ/4. Further, a cross-sectional area s of the second reflective portion 120 may be greater than d×λ/4.

The graph of FIG. 4D is based on results derived under conditions in which the frequency of the microwave radiation is 2.45 GHz, the minimum wavelength A of the microwave radiation is about 12 cm, λ/4 is about 3 cm, the depth d of the second reflective portion 120 is 1 cm, and the cross-sectional area s of the second reflective portion 120 is 6 $cm^2$.

It can be seen from the graph of FIG. 4D that the density of the microwave radiation absorbed in the center of the food is still higher than that of the microwave radiation absorbed at the other regions of the food. Therefore, it is difficult to expect the even heating of the food under conditions in which the depth d of the second reflective portion 120 is smaller than λ/4, and the cross-sectional area s of the second reflective portion 120 is greater than d×λ/4.

The description of FIGS. 4C and 4D is focused on the case in which only the second reflective portion 120 is formed in the bottom surface 21 of the cooking chamber 20. However, even when at least one of the first and second reflective portions 110 and 120 is formed at the bottom surface 21 of the cooking chamber 20, it is difficult to expect the even heating of the food. In this case, the height h of the first reflective portion 110 may be smaller than λ/4, and the cross-sectional area s of the first reflective portion 110 may be greater than h×λ/4. Further, the depth d of the second reflective portion 120 may be smaller than λ/4, and the cross-sectional area s of the second reflective portion 120 may be greater than d×λ/4.

Figure 4E:
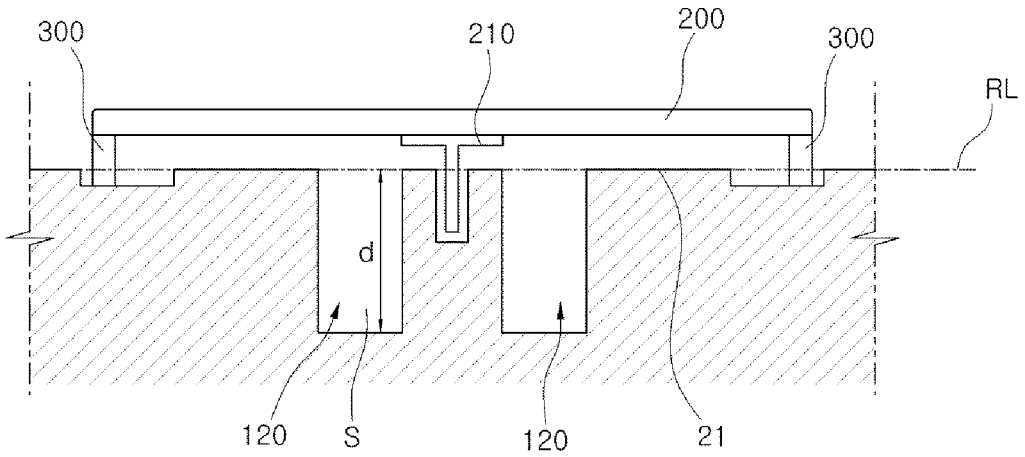
FIG. 4E is a sectional view illustrating a third bottom surface of the cooking chamber in the microwave oven according to the embodiment of the present invention.
Figure 4F:
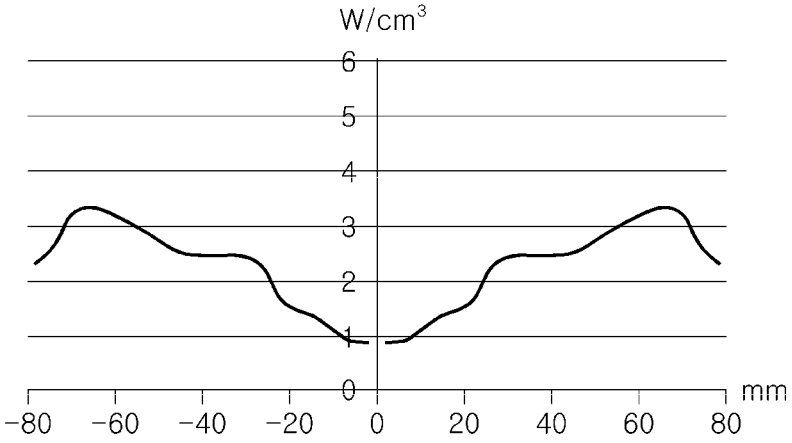
FIG. 4F is a graph illustrating a degree to which the food cooked in the cooking chamber to which the third bottom surface of FIG. 4E is applied is heated.

FIG. 4E is a sectional view illustrating a third bottom surface of the cooking chamber in the microwave oven according to the embodiment of the present invention, and FIG. 4F is a graph illustrating a degree to which the food cooked in the cooking chamber to which the third bottom surface of FIG. 4E is applied is heated. The transverse axis of the graph illustrated in FIG. 4F denotes a width (mm) from the center of the food, and the longitudinal axis denotes a density p (W/$cm^3$) of the microwave radiation absorbed by the food.

As illustrated in FIGS. 4E and 4F, when the second reflective portion 120 is formed in the bottom surface 21 of the cooking chamber 20, the food may be unevenly heated by the microwave radiation. At this time, the depth d of the second reflective portion 120 may be greater than λ/4. Further, the cross-sectional area s of the second reflective portion 120 may be smaller than d×λ/4.

The graph of FIG. 4F is based on results derived under conditions in which the frequency of the microwave radiation is 2.45 GHz, the minimum wavelength A of the microwave radiation is about 12 cm, λ/4 is about 3 cm, the depth d of the second reflective portion 120 is 3 cm, and the cross-sectional area s of the second reflective portion 120 is 4 $cm^2$.

It can be seen from the graph of FIG. 4F that the density of the microwave radiation absorbed in the center of the food is lower than that of the microwave radiation absorbed at the other regions of the food. Therefore, it is difficult to expect the even heating of the food under conditions in which the depth d of the second reflective portion 120 is greater than λ/4, and the cross-sectional area s of the second reflective portion 120 is smaller than d×λ/4.

The description of FIGS. 4E and 4F is focused on the case in which only the second reflective portion 120 is formed in the bottom surface 21 of the cooking chamber 20. However, even when at least one of the first and second reflective portions 110 and 120 is formed at the bottom surface 21 of the cooking chamber 20, it is difficult to expect the even heating of the food. In this case, the height h of the first reflective portion 110 may be greater than λ/4, and the cross-sectional area s of the first reflective portion 110 may be smaller than h×λ/4. Further, the depth d of the second reflective portion 120 may be greater than λ/4, and the cross-sectional area s of the second reflective portion 120 may be smaller than d×λ/4.

Figure 4G:
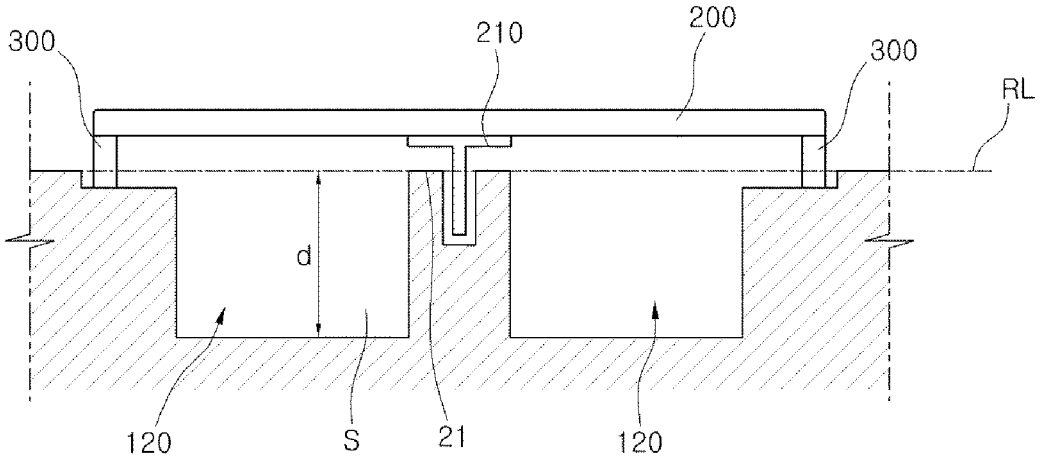
FIG. 4G is a sectional view illustrating a fourth bottom surface of the cooking chamber in the microwave oven according to the embodiment of the present invention.
Figure 4H:
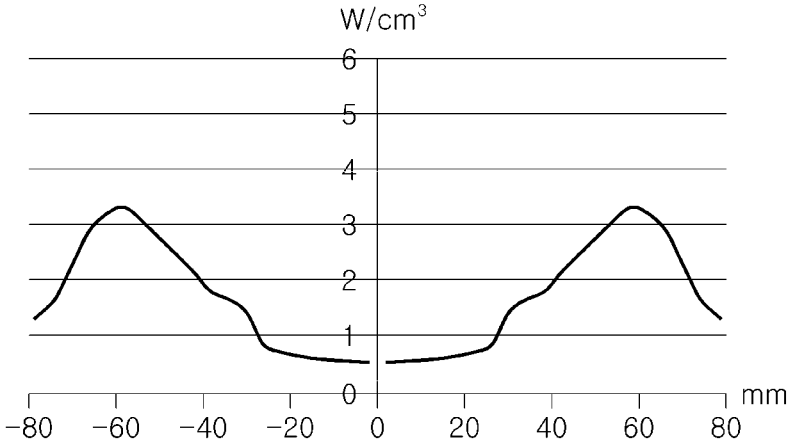
FIG. 4H is a graph illustrating a degree to which the food cooked in the cooking chamber to which the fourth bottom surface of FIG. 4G is applied is heated.

FIG. 4G is a sectional view illustrating a fourth bottom surface of the cooking chamber in the microwave oven according to the embodiment of the present invention, and FIG. 4H is a graph illustrating a degree to which the food cooked in the cooking chamber to which the fourth bottom surface of FIG. 4G is applied is heated. The transverse axis of the graph illustrated in FIG. 4H denotes a width (mm) from the center of the food, and the longitudinal axis denotes a density p (W/$cm^3$) of the microwave radiation absorbed by the food.

As illustrated in FIGS. 4G and 4H, when the second reflective portion 120 is formed in the bottom surface 21 of the cooking chamber 20, the food may be unevenly heated by the microwave radiation. At this time, the depth d of the second reflective portion 120 may be greater than λ/4. Further, the cross-sectional area s of the second reflective portion 120 may be greater than d×λ/4.

The graph of FIG. 4H is based on results derived under conditions in which the frequency of the microwave radiation is 2.45 GHz, the minimum wavelength A of the microwave radiation is about 12 cm, λ/4 is about 3 cm, the depth d of the second reflective portion 120 is 3 cm, and the cross-sectional area s of the second reflective portion 120 is 15 $cm^2$.

It can be seen from the graph of FIG. 4H that the density of the microwave radiation absorbed in the center of the food is lower than that of the microwave radiation absorbed at the other regions of the food. The graph of FIG. 4H has a tendency similar to that of the graph of FIG. 4F. However, it can be seen through comparison between the graph of FIG. 4F and the graph of FIG. 4H that waveforms of the graphs are different from each other. Consequently, it is difficult to expect the even heating of the food under conditions in which the depth d of the second reflective portion 120 is greater than λ/4, and the cross-sectional area s of the second reflective portion 120 is greater than d×λ/4.

The description of FIGS. 4G and 4H is focused on the case in which only the second reflective portion 120 is formed in the bottom surface 21 of the cooking chamber 20. However, even when at least one of the first and second reflective portions 110 and 120 is formed at the bottom surface 21 of the cooking chamber 20, it is difficult to expect the even heating of the food. In this case, the height h of the first reflective portion 110 may be greater than λ/4, and the cross-sectional area s of the first reflective portion 110 may be greater than h×λ/4. Further, the depth d of the second reflective portion 120 may be greater than λ/4, and the cross-sectional area s of the second reflective portion 120 may be greater than d×λ/4.

In conclusion, as illustrated in FIGS. 4A and 4B, it is possible to expect the even heating of the food under the conditions in which the depth d of the second reflective portion 120 is smaller than λ/4, and the cross-sectional area s of the second reflective portion 120 is smaller than d×λ/4. This effect can also be expected when at least one of the first and second reflective portions 110 and 120 is formed at the bottom surface 21 of the cooking chamber 20. In this case, the height h of the first reflective portion 110 may be smaller than λ/4, and the cross-sectional area s of the first reflective portion 110 may be smaller than h×λ/4. Further, the depth d of the second reflective portion 120 may be smaller than λ/4, and the cross-sectional area s of the second reflective portion 120 may be smaller than d×λ/4.

Figure 5A:
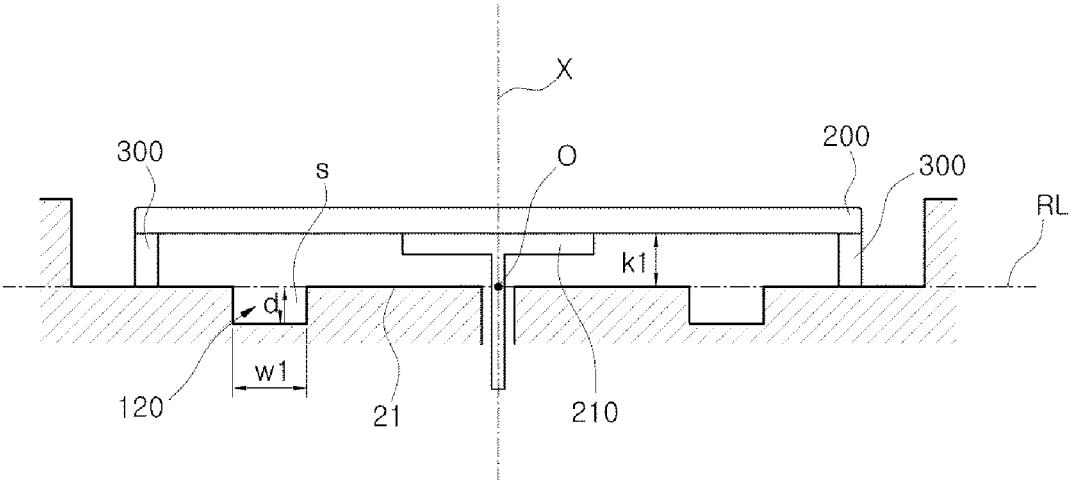
FIG. 5A is a sectional view illustrating the cooking chamber, on the bottom surface of which a pattern according to a first embodiment is formed, in the microwave oven according to the embodiment of the present invention.
Figure 5B:
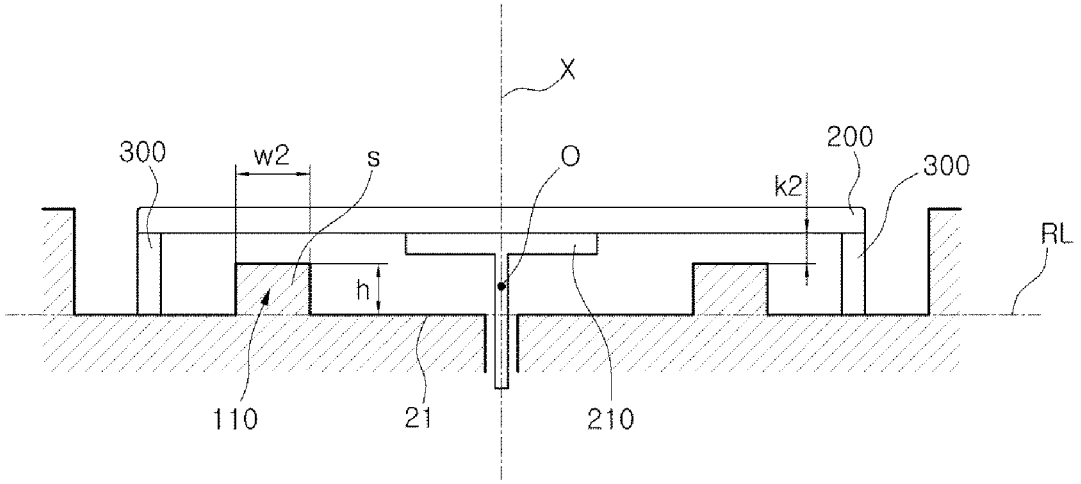
FIG. 5B is a sectional view illustrating the cooking chamber, on the bottom surface of which a pattern according to a second embodiment is formed, in the microwave oven according to the embodiment of the present invention.
Figure 5C:
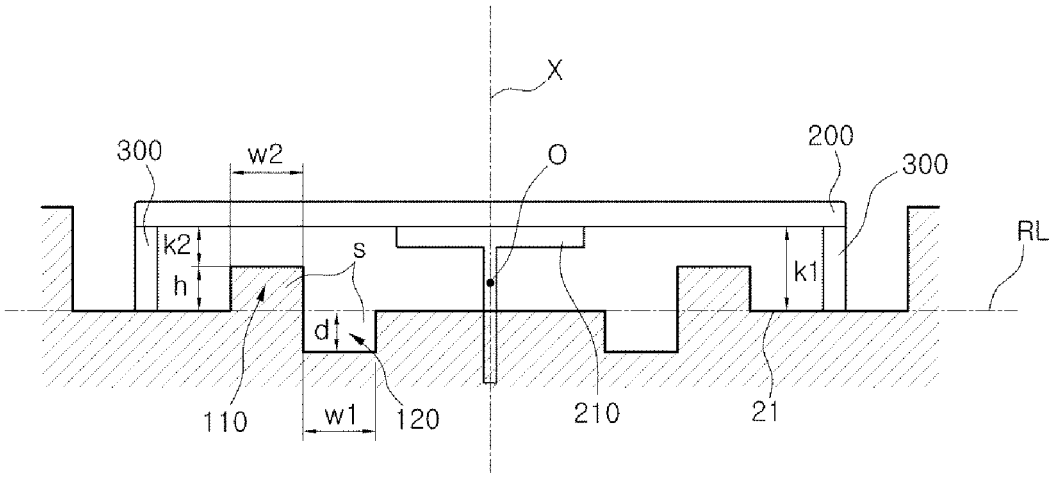
FIG. 5C is a sectional view illustrating the cooking chamber, on the bottom surface of which a pattern according to a third embodiment is formed, in the microwave oven according to the embodiment of the present invention.

FIG. 5A is a sectional view illustrating the cooking chamber, on the bottom surface of which a pattern according to a first embodiment is formed, in the microwave oven according to the embodiment of the present invention. FIG. 5B is a sectional view illustrating the cooking chamber, on the bottom surface of which a pattern according to a second embodiment is formed, in the microwave oven according to the embodiment of the present invention. FIG. 5C is a sectional view illustrating the cooking chamber, on the bottom surface of which a pattern according to a third embodiment is formed, in the microwave oven according to the embodiment of the present invention. FIG. 5A illustrates the bottom surface 21 of the cooking chamber 20 on which one concentric second reflective portion 120 is formed. FIG. 5B illustrates the bottom surface 21 of the cooking chamber 20 on which one concentric first reflective portion 110 is formed. FIG. 5C illustrates the bottom surface 21 of the cooking chamber 20 on which both the second reflective portion 120 and the first reflective portion 110 are formed.

The depth d of the second reflective portion 120 means a degree to which it is recessed from the reference level RL, and the height h of the first reflective portion 110 means a degree to which it protrudes from the reference level RL. The cross-sectional areas s of the first and second reflective portions 110 and 120 can be defined on the basis of cross sections of the first and second reflective portions 110 and 120 when the microwave oven 1 is cut along line I-I' of FIG. 1. Cutting the microwave oven 1 along line I-I' of FIG. 1 refers to cutting the microwave oven 1 along an imaginary plane that passes through the geometrical center O of the bottom surface 21 of the cooking chamber 20 and is perpendicular to the bottom surface 21 of the cooking chamber 20. Here, the geometrical center O of the bottom surface 21 of the cooking chamber 20 may refer to the center of gravity of the bottom surface 21 of the cooking chamber 20. As an example, in the case of the microwave oven 1 having the rotatable tray 200, the geometrical center O of the bottom surface 21 of the cooking chamber 20 may refer to a part of the bottom surface 21 of the cooking chamber 20 through which a rotational axis X of the tray 200 passes. In FIGS. 5A to 5C, the cross-sectional area s of the second reflective portion 120 can be defined by a product of the width w1 of the second reflective portion 120 and the depth d of the second reflective portion 120, and the cross-sectional area s of the first reflective portion 110 can be defined by a product of the width w2 of the first reflective portion 110 and the height h of the first reflective portion 110.

As illustrated in FIG. 5A, the second reflective portion 120 may be recessed below the reference level RL. Further, the depth d of the second reflective portion 120 may be smaller than $\lambda/4$. Further, the cross-sectional area s of the second reflective portion 120 may be smaller than $d\times\lambda/4$. In addition, a distance k1 between a highest point of the bottom surface 21 of the cooking chamber 20 and the tray 200 may be smaller than $\lambda/4$.

As illustrated in FIG. 5B, the first reflective portion 110 may protrude above the reference level RL. Further, the height h of the first reflective portion 110 may be smaller than $\lambda/4$. Further, the cross-sectional area s of the first reflective portion 110 may be smaller than $h\times\lambda/4$. In addition, a distance k2 between the first reflective portion 110 formed on the bottom surface 21 of the cooking chamber 20 and the tray 200 may be smaller than $\lambda/4$. To be specific, the distance k2 between the highest point of the first reflective portion 110 formed on the bottom surface 21 of the cooking chamber 20 and the tray 200 may be smaller than $\lambda/4$.

As illustrated in FIG. 5C, the second reflective portion 120 may be recessed below the reference level RL, and the first reflective portion 110 may protrude above the reference level RL. Description of the depth d and the cross-sectional area s of the second reflective portion 120 and the distance k1 between the highest point of the bottom surface 21 of the cooking chamber 20 and the tray 200 is the same as in FIG. 5A, and description of the height h and the cross-sectional area s of the first reflective portion 110, and the distance k2 between the highest point of the first reflective portion 110 and the tray 200 is the same as in FIG. 5B, and thus these descriptions will be omitted.

Figure 6A:
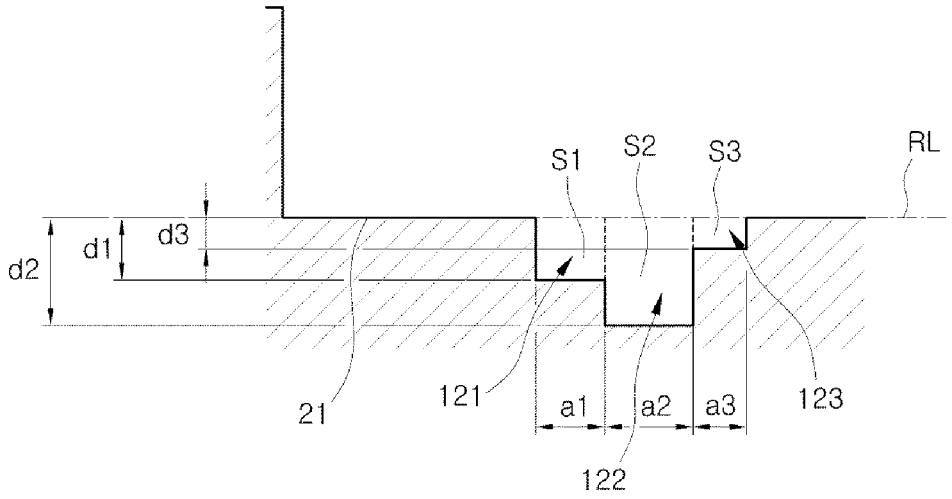
FIGS. 6A to 6F are sectional views illustrating various patterns that can be formed on the bottom surface of the cooking chamber in the microwave oven according to the embodiment of the present invention.
Figure 6B:
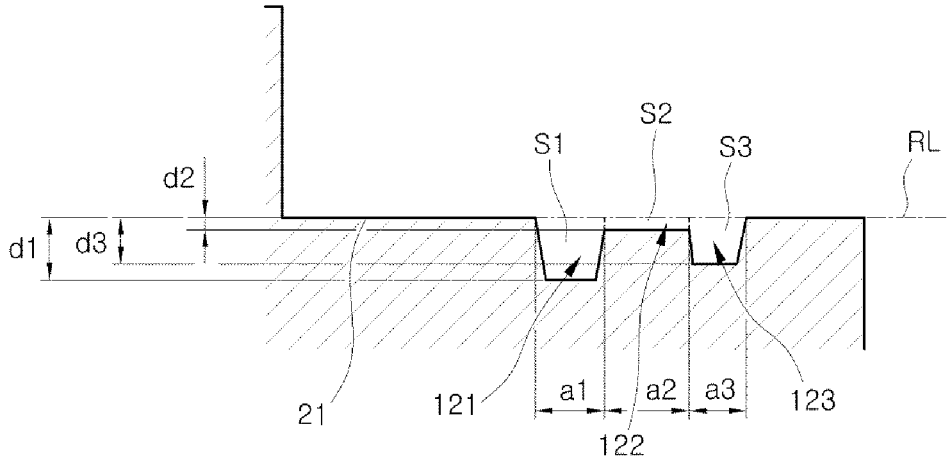
Figure 6C:
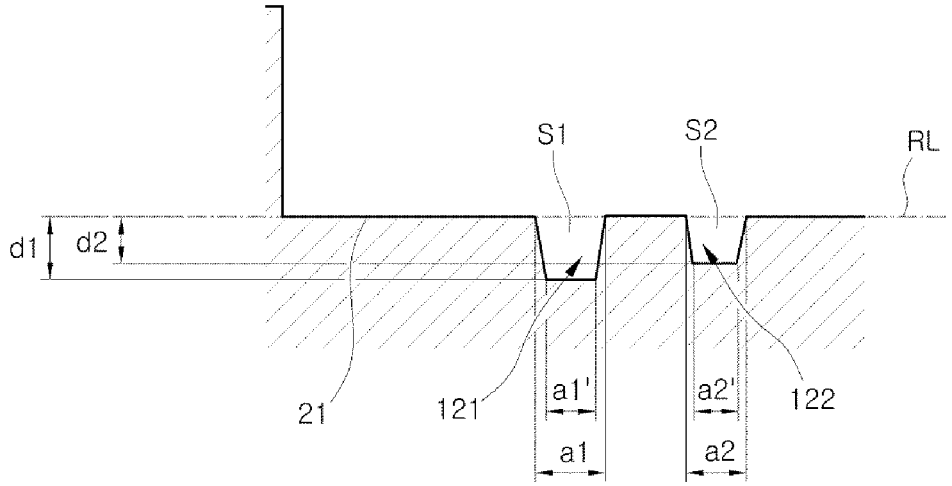
Figure 6D:
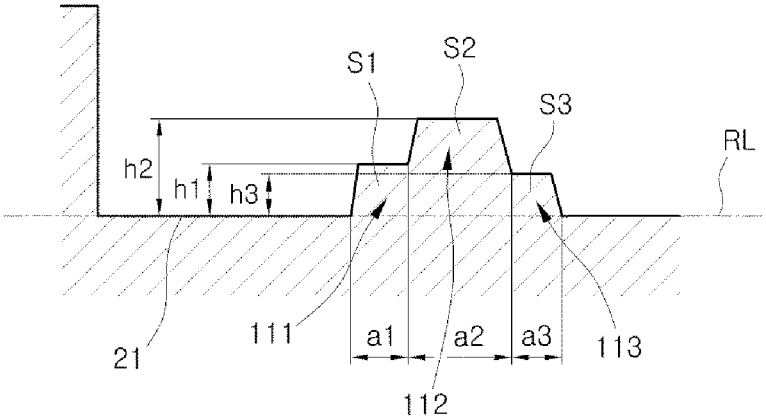
Figure 6E:
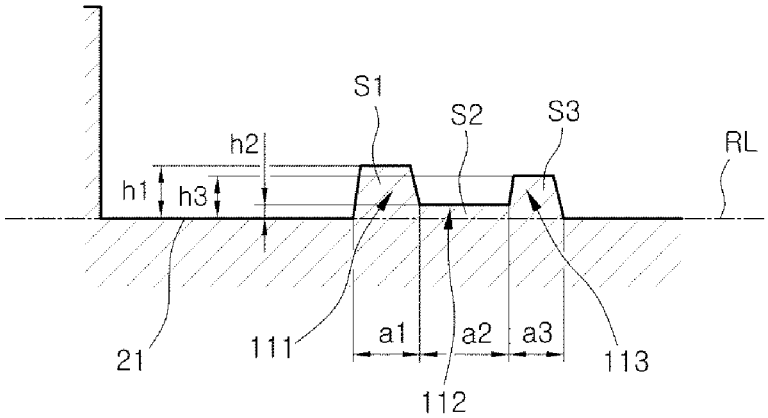
Figure 6F:
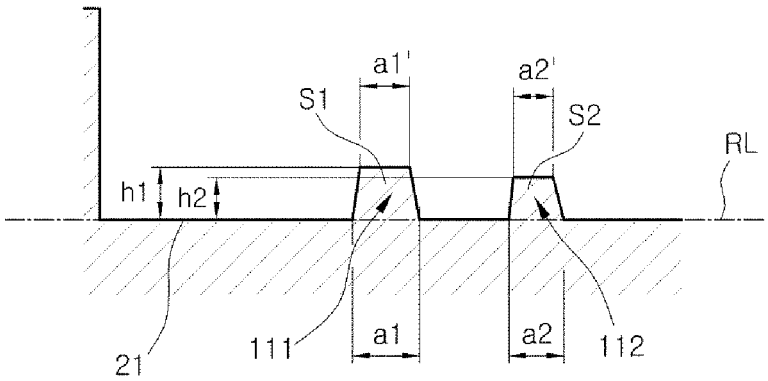

FIGS. 6A to 6F are sectional views illustrating various patterns that can be formed on the bottom surface of the cooking chamber in the microwave oven according to the embodiment of the present invention. FIGS. 6A to 6C are views illustrating various shapes of the second reflective portion 120 formed on the bottom surface 21 of the cooking chamber 20. FIGS. 6D to 6F are views illustrating various shapes of the first reflective portion 110 formed on the bottom surface 21 of the cooking chamber 20. In FIGS. 6A to 6F, the same reference numerals are given to elements having the same names. "RL" refers to the reference level.

As illustrated in FIG. 6A, the second reflective portion 120 may include a first space 121, a second space 122, and a third space 123 which have different depths. A depth d1 of the first space 121, a depth d2 of the second space 122, and a depth d3 of the third space 123 may be smaller than $\lambda/4$. Further, a cross-sectional area s1 of the first space 121, a cross-sectional area s2 of the second space 122, and a cross-sectional area s3 of the third space 123 may be smaller than $d\times\lambda/4$. The cross-sectional area s1 of the first space 121 is defined as a product of the depth d1 of the first space 121 and a width a1 of the first space 121. The cross-sectional area s2 of the second space 122 is defined as a product of the depth d2 of the second space 122 and a width a2 of the second space 122. The cross-sectional area s3 of the third space 123 is defined as a product of the depth d3 of the third space 123 and a width a3 of the third space 123.

As illustrated in FIG. 6B, the second reflective portion 120 may include a first space 121, a second space 122, and a third space 123 which have different depths. The second space 122 may be recessed from the reference level RL to a very small degree, compared to the neighboring first and third spaces 121 and 123. A depth d1 of the first space 121, a depth d2 of the second space 122, and a depth d3 of the third space 123 may be smaller than $\lambda/4$. Further, a cross-sectional area s1 of the first space 121, a cross-sectional area s2 of the second space 122, and a cross-sectional area s3 of the third space 123 may be smaller than $d\times\lambda/4$. A width a2 of the second space 122 may be greater than a width a1 of the first space 121 and a width a3 of the third space 123.

As illustrated in FIG. 6C, the first space 120 may include a first space 121 and a second space 122 which have different depths. A depth d1 of the first space 121 and a depth d2 of the second space 122 may be smaller than $\lambda/4$. Further, a cross-sectional area s1 of the first space 121 and a cross-sectional area s2 of the second space 122 may be smaller than $\lambda/4$.

Assuming that the first space 121 and the second space 122 have trapezoidal shapes, the cross-sectional area s1 of the first space 121 can be defined as a formula "Cross-sectional area s1 of the first space 121={(First width a1)+(Second width a1')}×Depth d1 of the first space 121×½." Further, the cross-sectional area s2 of the second space 122 can be defined as a formula "Cross-sectional area s2 of the second space 122={(First width a2)+(Second width a2')}×

Depth d2 of the second space 122×½." The first space 121 and the second space 122 may be spaced a given distance apart from each other.

As illustrated in FIG. 6D, the first reflective portion 110 may include a first region 111, a second region 112, and a third region 113 which have different heights. A height h1 of the first region 111, a height h2 of the second region 112, and a height h3 of the third region 113 may be smaller than λ/4. Further, a cross-sectional area s1 of the first region 111, a cross-sectional area s2 of the second region 112, and a cross-sectional area s3 of the third region 113 may be smaller than h×λ/4. A width a2 of the second region 112 may be greater than a width a1 of the first region 111 and a width a3 of the third region 113.

As illustrated in FIG. 6E, the first reflective portion 110 may include a first region 111, a second region 112, and a third region 113 which have different heights. A height h1 of the first region 111, a height h2 of the second region 112, and a height h3 of the third region 113 may be smaller than λ/4. Especially, the height h2 of the second region 112 may be smaller than the heights h1 and h3 of the neighboring first and third regions 111 and 113. Further, a cross-sectional area s1 of the first region 111, a cross-sectional area s2 of the second region 112, and a cross-sectional area s3 of the third region 113 may be smaller than h×λ/4.

As illustrated in FIG. 6F, the first reflective portion 110 may include a first region 111 and a second region 112 which have different heights. A height h1 of the first region 111 and a height h2 of the second region 112 may be smaller than λ/4. Further, a cross-sectional area s1 of the first region 111 and a cross-sectional area s2 of the second region 112 may be smaller than h×λ/4. Assuming that the first region 111 and the second region 112 have trapezoidal shapes, the cross-sectional area s1 of the first region 111 can be defined as a formula "Cross-sectional area s1 of the first region 111={(First width a1)+(Second width a1')}×Height h1 of the first region 111×½." The cross-sectional area s2 of the second region 112 can be defined as a formula "Cross-sectional area s2 of the second region 112={(First width a2)+(Second width a2')}×Height h2 of the second region 112×½." The first region 111 and the second region 112 may be spaced a given distance apart from each other.

How the cross-sectional area is found when the second reflective portion 120 has the quadrilateral shape in FIG. 6A and when the first reflective portion 110 has the trapezoidal shape in FIGS. 6C and 6F has been described in detail. At least one of the shapes of the first and second reflective portions 110 and 120 is not limited to the quadrilateral shape and the trapezoidal shapes, but can be variously modified. As an example, at least one of the shapes of the first and second reflective portions 110 and 120 may include a curved surface. A method of finding at least one of the cross-sectional areas of the first and second reflective portions 110 and 120 may be dependent on each shape.

Figure 7A:
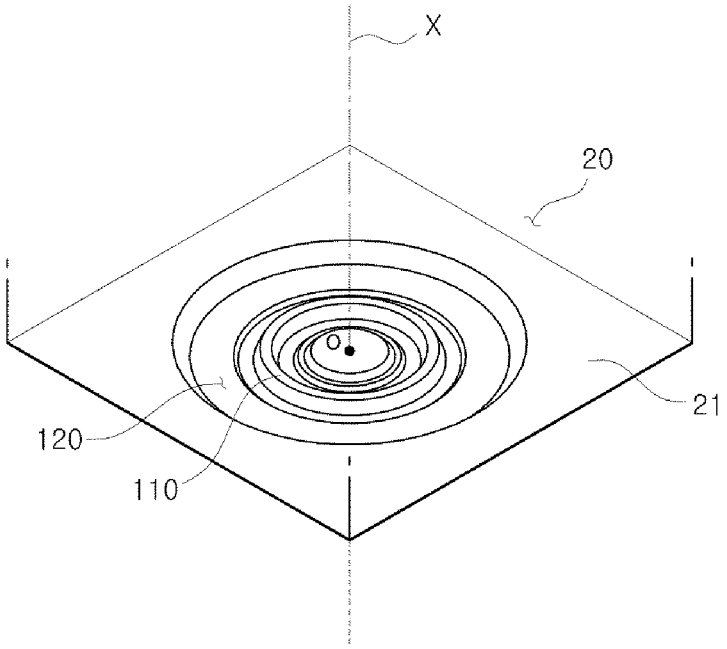
FIG. 7A is a view illustrating the cooking chamber, on the bottom surface of which a pattern according to a fourth embodiment is formed, in the microwave oven according to the embodiment of the present invention.
Figure 7B:
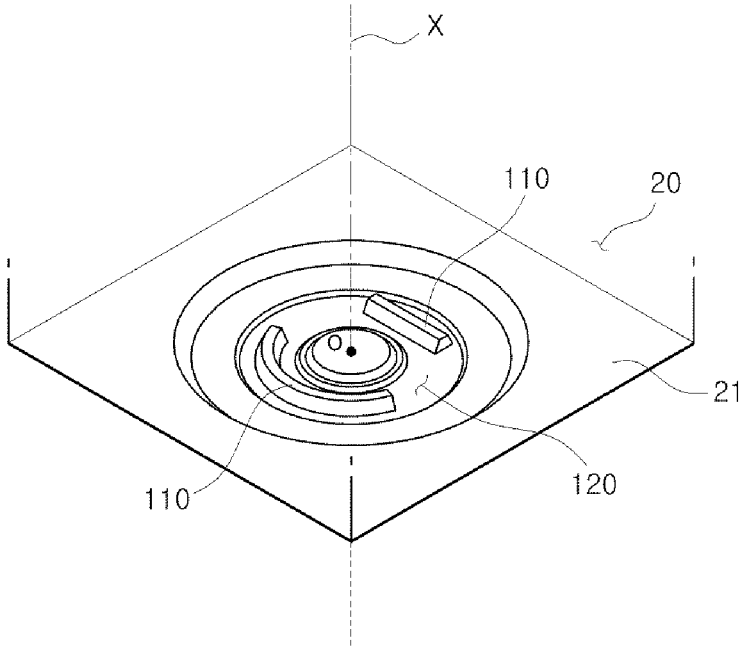
FIG. 7B is a view illustrating the cooking chamber, on the bottom surface of which a pattern according to a fifth embodiment is formed, in the microwave oven according to the embodiment of the present invention.
Figure 7C:
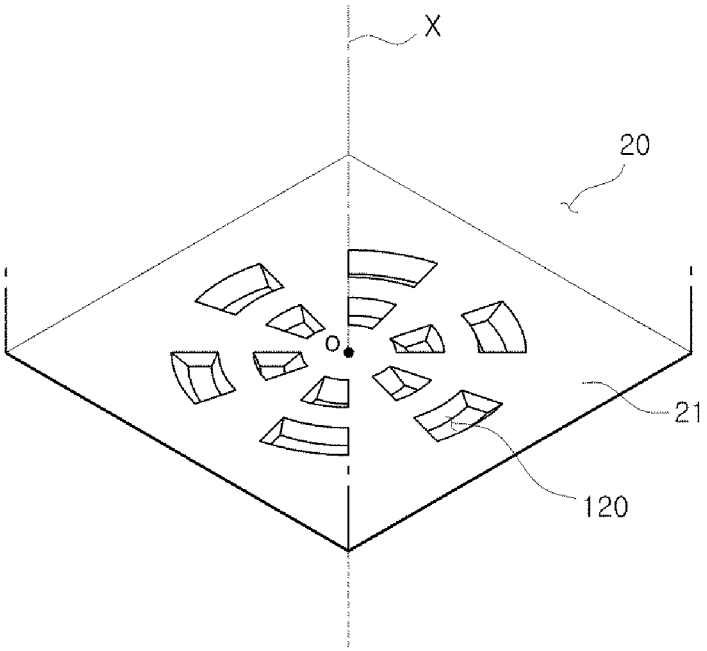
FIG. 7C is a view illustrating the cooking chamber, on the bottom surface of which a pattern according to a sixth embodiment is formed, in the microwave oven according to the embodiment of the present invention.
Figure 7D:
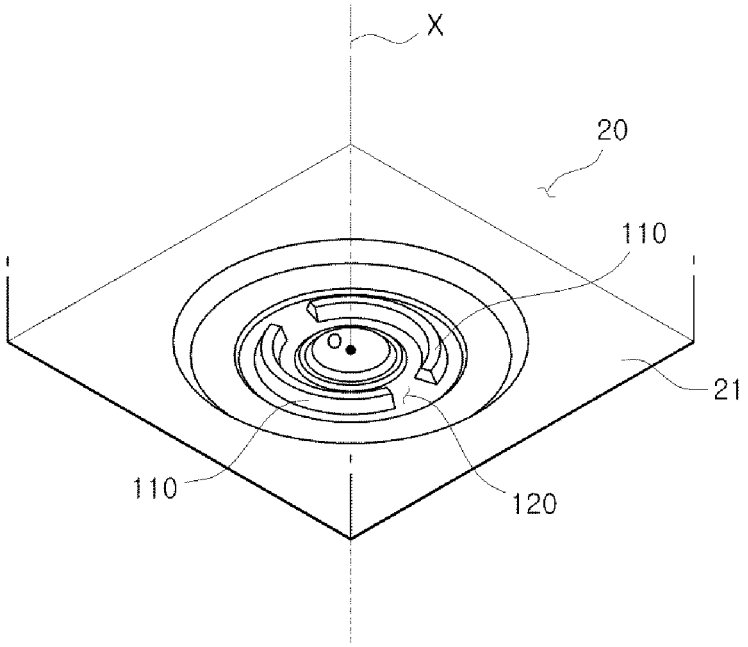
FIG. 7D is a view illustrating the cooking chamber, on the bottom surface of which a pattern according to a seventh embodiment is formed, in the microwave oven according to the embodiment of the present invention.

FIG. 7A is a view illustrating the cooking chamber, on the bottom surface of which a pattern according to a fourth embodiment is formed, in the microwave oven according to the embodiment of the present invention. FIG. 7B is a view illustrating the cooking chamber, on the bottom surface of which a pattern according to a fifth embodiment is formed, in the microwave oven according to the embodiment of the present invention. FIG. 7C is a view illustrating the cooking chamber, on the bottom surface of which a pattern according to a sixth embodiment is formed, in the microwave oven according to the embodiment of the present invention. FIG. 7D is a view illustrating the cooking chamber, on the bottom surface of which a pattern according to a seventh embodiment is formed, in the microwave oven according to the embodiment of the present invention.

As illustrated in FIG. 7A, a pattern having a symmetrical structure may be formed on the bottom surface 21 of the cooking chamber 20. To be specific, at least one of the first reflective portion 110 and the second reflective portion 120 may be formed in the shape of a closed loop having a symmetrical structure. As an example, at least one of the first reflective portion 110 and the second reflective portion 120 may be formed in the shape of a plurality of circles whose centers are identical to the geometrical center O of the bottom surface 21 of the cooking chamber 20 and whose diameters increase toward the outside of the bottom surface 21 of the cooking chamber 20. At least one of the first reflective portion 110 and the second reflective portion 120 may have the relationship of a concentric circle whose center is identical to the geometrical center O of the bottom surface 21 of the cooking chamber 20. In another aspect, at least one of the first reflective portion 110 and the second reflective portion 120 may have a symmetrical structure with respect to a plane including the rotational axis X of the tray 200 which passes through the geometrical center O of the bottom surface 21 of the cooking chamber 20.

As illustrated in FIG. 7B, a pattern having a structure of mirror symmetry may be formed on the bottom surface 21 of the cooking chamber 20. To be specific, at least one of the first reflective portion 110 and the second reflective portion 120 may have a structure of mirror symmetry with respect to a plane including the rotational axis X of the tray 200 which passes through the geometrical center O of the bottom surface 21 of the cooking chamber 20.

As illustrated in FIG. 7C, a pattern having a structure of rotational symmetry may be formed on the bottom surface 21 of the cooking chamber 20. To be specific, at least one of the first reflective portion 110 and the second reflective portion 120 may have a structure of rotational symmetry with respect to a plane including the rotational axis X of the tray 200 which passes through the geometrical center O of the bottom surface 21 of the cooking chamber 20.

As illustrated in FIG. 7D, a pattern in which a plurality of symmetrical structures are mixed may be formed on the bottom surface 21 of the cooking chamber 20. As an example, the pattern in which the plurality of symmetrical structures are mixed may be a pattern in which the symmetrical structure in the closed loop shape illustrated in FIG. 7A and the structure of mirror symmetry illustrated in FIG. 7B are mixed. However, a type of the pattern in which the plurality of symmetrical structures are mixed is not limited to the above example. As illustrated in FIG. 7D, at least one of the first reflective portion 110 and the second reflective portion 120 may have a symmetrical structure with respect to a plane including the rotational axis X of the tray 200 which passes through the geometrical center O of the bottom surface 21 of the cooking chamber 20.

The pattern formed on the bottom surface 21 of the cooking chamber 20 may have an asymmetrical structure in addition to the symmetrical structure. As an example, when a plurality of second reflective portions 120 and a plurality of first reflective portions 110 are formed on the bottom surface 21 of the cooking chamber 20, at least one of the plurality of second reflective portions 120 or at least one of the plurality of first reflective portions 110 may be formed in an asymmetrical structure.

Figure 8A:
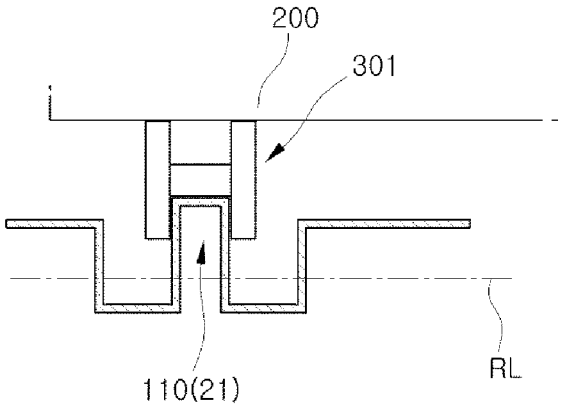
FIGS. 8A to 8D are views illustrating a relationship between a wheel and the cooking chamber, on the bottom surface of which various patterns are formed, in the microwave oven according to the embodiment of the present invention.
Figure 8B:
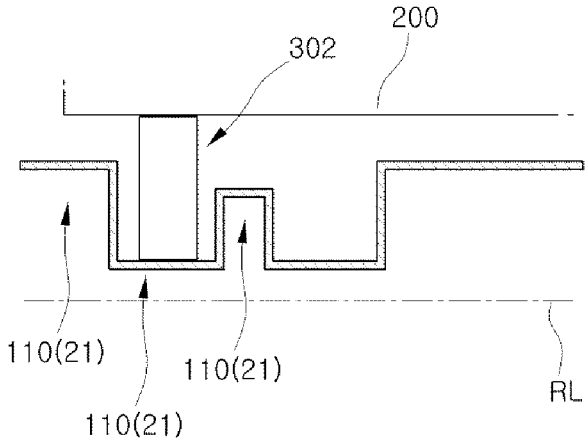
Figure 8C:
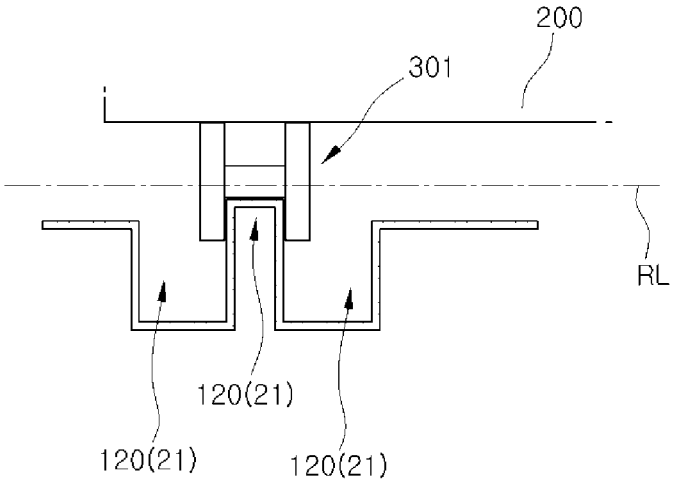
Figure 8D:
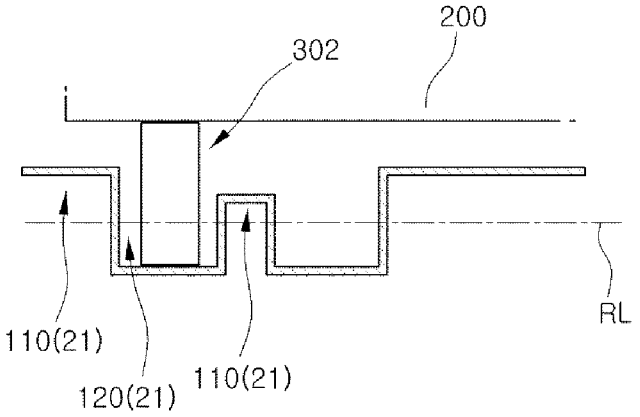

FIGS. 8A to 8D are views illustrating a relationship between a wheel and the cooking chamber, on the bottom surface of which various patterns are formed, in the microwave oven according to the embodiment of the present invention. The wheel illustrated in FIGS. 8A and 8C is referred to as a first wheel 301, and the wheel illustrated in FIGS. 8B and 8D is referred to as a second wheel 302.

As illustrated in FIGS. 8A to 8D, the pattern formed on the bottom surface 21 of the cooking chamber 20 may serve to guide the wheel 300 that rotatably supports the tray 200. In other words, at least one of the first and second reflective portions 110 and 120 formed on the bottom surface 21 of the cooking chamber 20 may serve to guide the wheel 300 supporting the tray 200 that rotates about the rotational axis X (see FIG. 7A) of the tray 200 which passes through the geometrical center O of the bottom surface 21 of the cooking chamber 20.

As illustrated in FIG. 8A, the first wheel 301 may rotatably support the tray 200 in a state in which it is coupled to the first reflective portion 110 protruding above the reference level RL.

As illustrated in FIG. 8B, the second wheel 302 may rotatably support the tray 200 in a state in which it is located on the first reflective portion 110 protruding above the reference level RL. Otherwise, the second wheel 302 may rotatably support the tray 200 in a state in which it is housed between the plurality of first reflective portions 110 protruding above the reference level RL.

As illustrated in FIG. 8C, the first wheel 301 may rotatably support the tray 200 in a state in which it is coupled to the second reflective portion 120 recessed below the reference level RL.

As illustrated in FIG. 8D, the second wheel 302 may rotatably support the tray 200 in a state in which it is located on the second reflective portion 120 recessed below the reference level RL. Otherwise, the second wheel 302 may rotatably support the tray 200 in a state in which it is housed between the plurality of second reflective portions 120 recessed below the reference level RL.

Figure 9A:
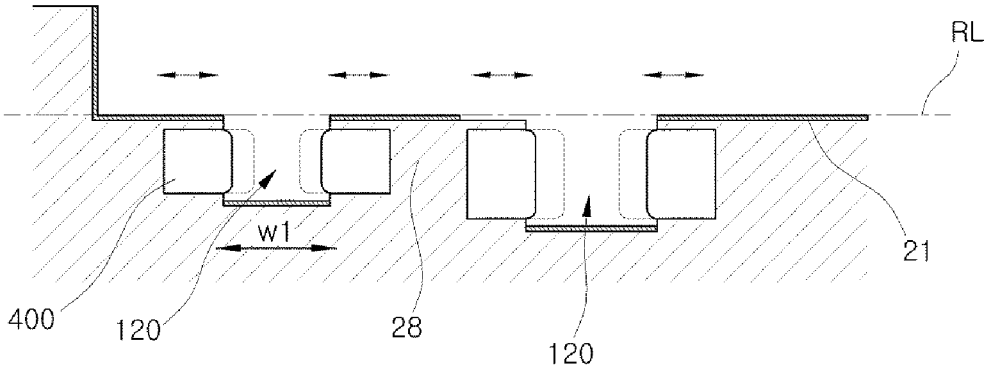
FIG. 9A is a view illustrating the cooking chamber, on the bottom surface of which a variable pattern according to an eighth embodiment is formed, in the microwave oven according to the embodiment of the present invention.
Figure 9B:
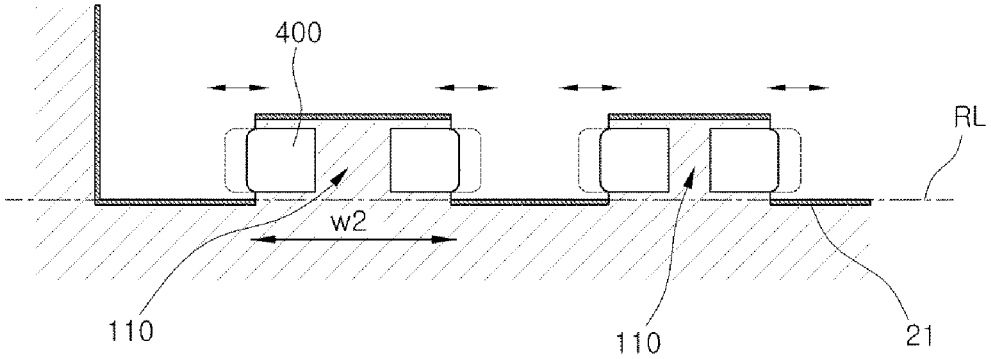
FIG. 9B is a view illustrating the cooking chamber, on the bottom surface of which a variable pattern according to a ninth embodiment is formed, in the microwave oven according to the embodiment of the present invention.

FIG. 9A is a view illustrating the cooking chamber, on the bottom surface of which a variable pattern according to an eighth embodiment is formed, in the microwave oven according to the embodiment of the present invention, and FIG. 9B is a view illustrating the cooking chamber, on the bottom surface of which a variable pattern according to a ninth embodiment is formed, in the microwave oven according to the embodiment of the present invention. FIGS. 9A and 9B illustrate the bottom surface 21 of the cooking chamber 20 in which a width of the pattern is variable. To be specific, FIG. 9A illustrates the bottom surface 21 of the cooking chamber 20 in which a width of the second reflective portion 120 is variable, and FIG. 9B illustrates the bottom surface 21 of the cooking chamber 20 in which a width of the first reflective portion 110 is variable. "RL" refers to the reference level.

The width w1 of the second reflective portion 120 and the width w2 of the first reflective portion 110 may be changed depending on a method of operating the microwave oven 1 according to a type, weight, initial state, etc. of the food.

To be specific, the width w1 of the second reflective portion 120 or the width w2 of the first reflective portion 110 may be automatically changed by an elastic body in correspondence with the weight, etc. of the food. Otherwise, the width w1 of the second reflective portion 120 or the width w2 of the first reflective portion 110 may be mechanically changed according to manual selection by a user. Otherwise, the width w1 of the second reflective portion 120 or the width w2 of the first reflective portion 110 may be changed by a hydraulic or pneumatic cylinder in correspondence with the weight, etc. of the food.

As illustrated in FIG. 9A, the width w1 of the second reflective portion 120 is mechanically variable. As an example, a plurality of moving units 400 may be installed in the bottom surface 21 of the cooking chamber 20. The plurality of moving units 400 may be installed in a partition 28 defining the second reflective portion 120 to be movable in a horizontal direction. When the plurality of moving units 400 move from the partition 28 toward the second reflective portion 120, the width w1 of the second reflective portion 120 decreases. In contrast, when the plurality of moving units 400 protruding to the inside of the second reflective portion 120 move toward the partition 28, the width w1 of the second reflective portion 120 increases.

As illustrated in FIG. 9B, the width w2 of the first reflective portion 110 is mechanically variable. As an example, a plurality of moving units 400 may be installed in the bottom surface 21 of the cooking chamber 20. The plurality of moving units 400 may be installed in the first reflective portion 110 to be movable in a horizontal direction. When the plurality of moving units 400 move toward the outside of the first reflective portion 110, the width w2 of the first reflective portion 110 increases. In contrast, when the plurality of moving units 400 move toward the inside of the first reflective portion 110, the width w2 of the first reflective portion 110 decreases.

As this variable pattern is formed on the bottom surface 21 of the cooking chamber 20, the food can be evenly heated irrespective of the type or the weight of the food.

Figure 10A:
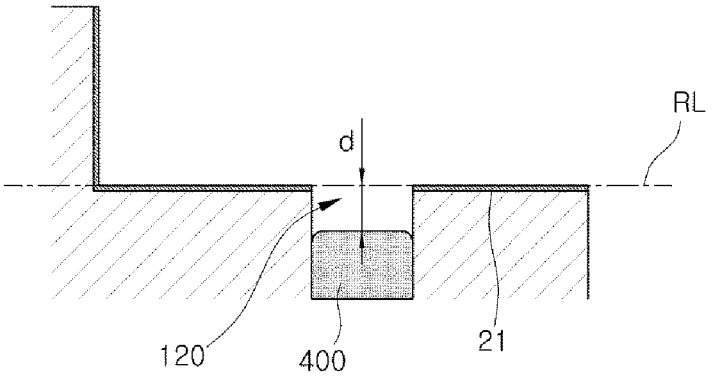
Figure 10B:
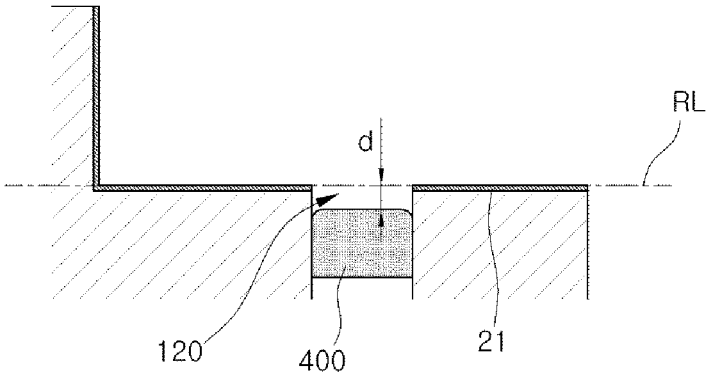
Figure 10C:
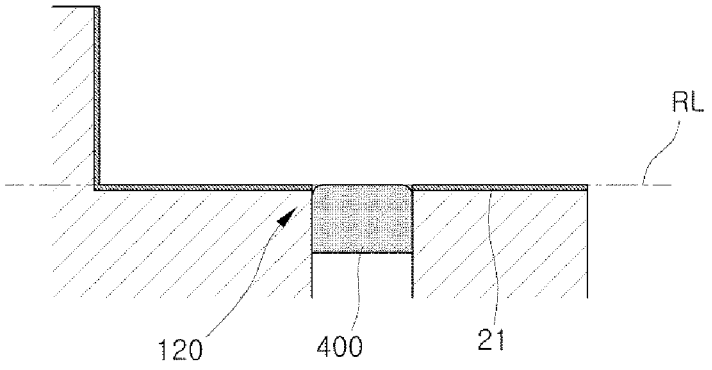

FIGS. 10A to 10C are views illustrating a process in which a variable pattern according to a tenth embodiment is operated in the microwave oven according to the embodiment of the present invention. FIGS. 10A to 10C illustrate a process in which the depth d of the second reflective portion 120 is changed. "RL" refers to the reference level.

The depth d of the second reflective portion 120 may be changed depending on a method of operating the microwave oven 1 according to a type, weight, initial state, etc. of the food.

To be specific, the depth d of the second reflective portion 120 may be automatically changed by an elastic body in correspondence with the weight, etc. of the food. Otherwise, the depth d of the second reflective portion 120 may be mechanically changed according to manual selection by a user. Otherwise, the depth d of the second reflective portion 120 may be changed by a hydraulic or pneumatic cylinder in correspondence with the weight, etc. of the food.

As illustrated in FIGS. 10A to 10C, the depth d of the second reflective portion 120 is mechanically variable. As an example, a moving unit 400 may be installed in the bottom surface 21 of the cooking chamber 20. According to circumstances, the moving unit 400 may define a bottom surface of the second reflective portion 120, and be installed to be movable in a horizontal direction. FIGS. 10A and 10B illustrate a case in which the moving unit 400 defines the bottom surface of the second reflective portion 120. As an example, the moving unit 400 may be installed to be movable in a horizontal direction using an elastic body such as a spring. As this variable pattern is formed on the bottom surface 21 of the cooking chamber 20, the food can be evenly heated irrespective of the type or the weight of the food. FIG. 10A illustrates a case in which the depth d of the second reflective portion 120 is deepest. FIG. 10B illustrates a case in which the depth d of the second reflective portion 120 is reduced by upward movement of the moving unit 400. By comparing FIGS. 10A and 10B, it can be seen that the depth d of the second reflective portion 120 is further reduced in FIG. 10B than in FIG. 10A by the upward movement of the moving unit 400. FIG. 10C illustrates a case in which the moving unit 400 moves upward until it is flush with the reference level RL and the second reflective portion 120 disappears. Although FIGS. 10A to 10C illustrate the case in which one moving unit 400 is installed in the bottom surface 21 of the cooking chamber 20, a plurality of moving units 400 may be installed in the bottom surface 21 of the cooking chamber 20. At this time, the plurality of moving units 400 may move up and down independently of each other.

The width w1 and the depth d of the second reflective portion 120 may be simultaneously changed.

Figure 11A:
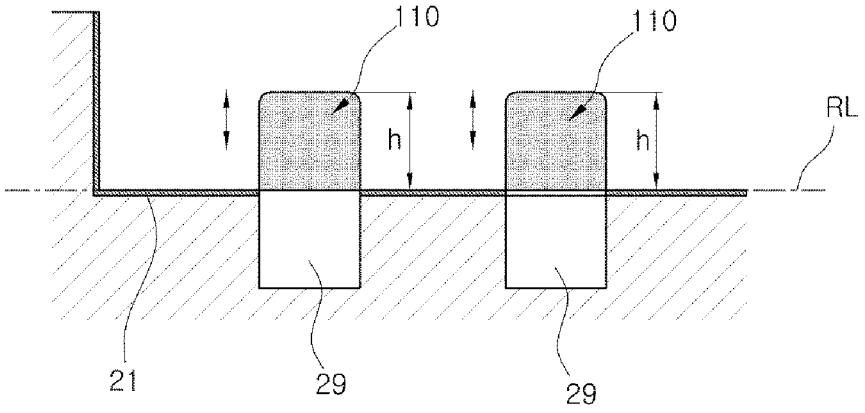
FIGS. 11A and 11B are views illustrating a process in which a variable pattern according to an eleventh embodiment is operated in the microwave oven according to the embodiment of the present invention.
Figure 11B:
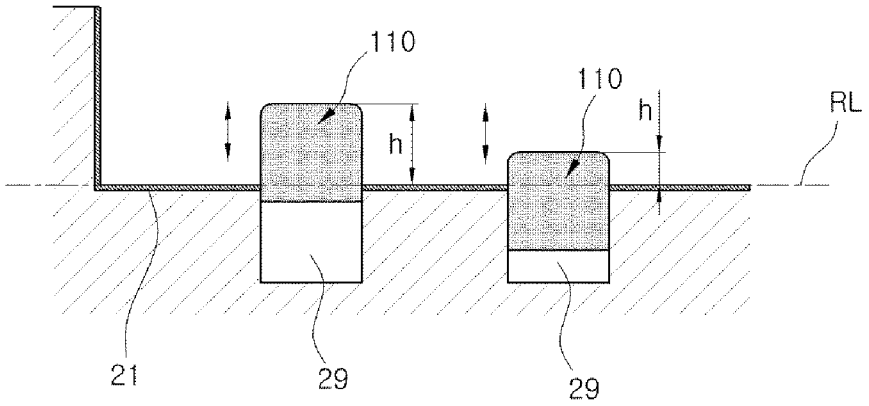

FIGS. 11A and 11B are views illustrating a process in which a variable pattern according to an eleventh embodiment is operated in the microwave oven according to the embodiment of the present invention. FIGS. 11A and 11B illustrate different embodiments in which the heights h of the first reflective portions 110 are changed. "RL" refers to the reference level.

The heights h of the first reflective portions 110 may be changed depending on a method of operating the microwave oven 1 according to a type, weight, initial state, etc. of the food.

To be specific, the height h of each of the first reflective portions 110 may be automatically changed by an elastic body in correspondence with the weight, etc. of the food. Otherwise, the height h of each of the first reflective portions 110 may be mechanically changed according to manual selection by a user. Otherwise, the height h of each of the first reflective portions 110 may be changed by a hydraulic or pneumatic cylinder in correspondence with the weight, etc. of the food.

As illustrated in FIGS. 11A and 11B, the height h of each of the first reflective portions 110 is mechanically variable. As an example, a guide portion 29 at which each of the first reflective portions 110 is movable may be formed in the bottom surface 21 of the cooking chamber 20. The guide portion 29 may have the shape of a groove deeply cut in the bottom surface 21 of the cooking chamber 20 in a vertical direction such that each of the first reflective portions 110 is movable. The first reflective portion 110 is movable along the guide portion 29 in a vertical direction. As an example, the first reflective portion 110 is vertically movable along the guide portion 29 by means of an elastic body such as a spring. When the first reflective portion 110 moves up along the guide portion 29, the height h of the first reflective portion 110 increases. In contrast, when the first reflective portion 110 moves down along the guide portion 29, the height h of the first reflective portion 110 decreases. As this variable pattern is formed on the bottom surface 21 of the cooking chamber 20, the food can be evenly heated irrespective of the type or the weight of the food.

As illustrated in FIG. 11A, the plurality of first reflective portions 110 formed on the bottom surface 21 of the cooking chamber 20 are movable in an interlocked manner. That is, the heights h of the plurality of first reflective portions 110 can be integrally changed.

Further, as illustrated in FIG. 11B, the plurality of first reflective portions 110 formed on the bottom surface 21 of the cooking chamber 20 are movable independently of each other. That is, the heights h of the plurality of first reflective portions 110 can be independently changed.

Both the width w2 and the height h of the first reflective portion 110 may be changed at the same time.

Figure 12A:
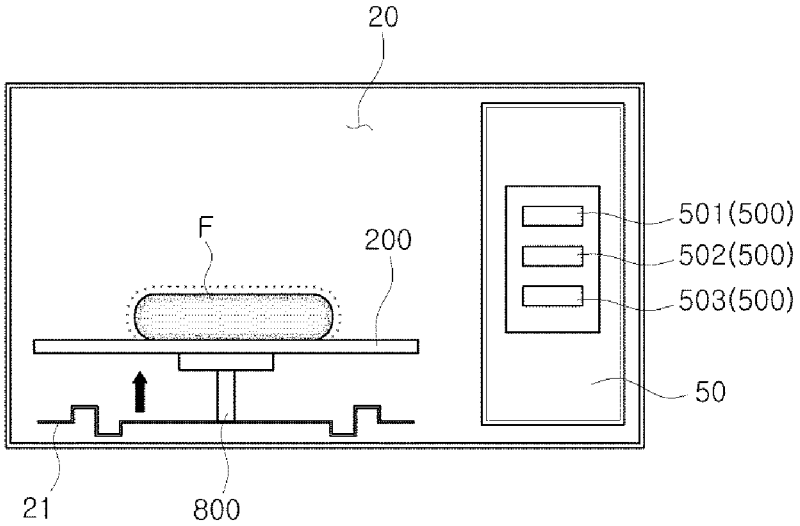
FIGS. 12A and 12B are views illustrating how a height of the tray is manually adjusted according to an initial temperature of the food in the microwave oven according to the embodiment of the present invention.
Figure 12B:
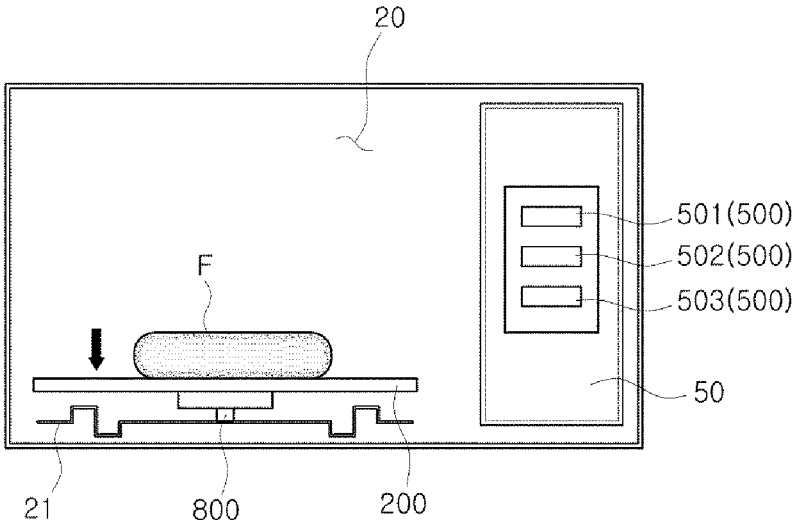

FIGS. 12A and 12B are views illustrating how a height of the tray is manually adjusted according to an initial temperature of the food in the microwave oven according to the embodiment of the present invention. FIGS. 12A and 12B illustrate a case in which the height of the tray 200 is manually adjusted by a user according to a state of the food. At least one adjustment button 500 may be formed on the control panel 50. A reference number 800 of FIGS. 12A and 12B denotes a "tray support." The tray support 800 supports the tray 200, and is simultaneously movable in a vertical direction. The tray support 800 may include a spring damper, a pneumatic cylinder, or the like.

The height of the tray 200 may be changed according to the state of the food placed on the tray 200. The state of the food includes a type of the food, a weight of the food, a density of the food, an initial temperature of the food, and so on.

As illustrated in FIGS. 12A and 12B, the height of the tray 200 may be manually adjusted according to the initial temperature of the food placed on the tray 200. As illustrated in FIG. 12A, when the initial temperature of the food is low, a distance between the bottom surface 21 of the cooking chamber 20 and the tray 200 is reduced. That is, the height of the tray 200 is reduced. Here, the initial temperature of the food is said to be low when the initial temperature of the food is lower than −15° C. As illustrated in FIG. 12B, when the initial temperature of the food is high, the distance between the bottom surface 21 of the cooking chamber 20 and the tray 200 is increased. That is, the height of the tray 200 is increased. This is because it takes longer to heat the food when the initial temperature of the food is lower. By reducing the distance between the tray 200 and the bottom surface 21 of the cooking chamber 20, the microwave radiation reflected from the bottom surface 21 of the cooking chamber 20 can be more effectively transmitted to the food.

When a user intends to manually adjust the height of the tray 200 according to the initial temperature of the food, the user may select a first adjustment button 501. If the user selects the first adjustment button 501, a temperature detecting sensor (not illustrated) for the food is operated to measure a temperature of the food. According to the result, the height of the tray 200 is adjusted.

Further, the height of the tray 200 may be manually adjusted according to the density of the food placed on the tray 200. When the density of the food is low, the distance between the bottom surface 21 of the cooking chamber 20 and the tray 200 is increased. That is, the height of the tray 200 is increased. When the density of the food is high, the distance between the bottom surface 21 of the cooking chamber 20 and the tray 200 is reduced. That is, the height of the tray 200 is reduced. This is because it takes longer to heat the food when the density of the food is higher. By reducing the distance between the tray 200 and the bottom surface 21 of the cooking chamber 20, the microwave radiation reflected from the bottom surface 21 of the cooking chamber 20 can be more effectively transmitted to the food.

When a user intends to manually adjust the height of the tray 200 according to the density of the food, the user may select a second adjustment button 502. If the user selects the second adjustment button 502, a density detecting sensor (not illustrated) for the food is operated to measure a density of the food. According to the result, the height of the tray 200 is adjusted.

Low-density foods may include, for instance, fruits or vegetables. High-density foods may include, for instance, meats.

Further, the height of the tray 200 may be manually adjusted according to the weight of the food placed on the tray 200. When the weight of the food is small, the distance between the bottom surface 21 of the cooking chamber 20 and the tray 200 is increased. That is, the height of the tray 200 is increased. When the weight of the food is great, the distance between the bottom surface 21 of the cooking chamber 20 and the tray 200 is reduced. That is, the height of the tray 200 is reduced. This is because it takes longer to heat the food when the weight of the food is greater. By reducing the distance between the tray 200 and the bottom surface 21 of the cooking chamber 20, the microwave radiation reflected from the bottom surface 21 of the cooking chamber 20 can be more effectively transmitted to the food.

When a user intends to manually adjust the height of the tray 200 according to the weight of the food, the user may select a third adjustment button 503. If the user selects the third adjustment button 503, a weight detecting sensor (not illustrated) for the food is operated to measure the weight of the food. According to the result, the height of the tray 200 is adjusted.

As the user selects the adjustment button 500, not only the height of the tray 200 but also the width, height, depth, etc. of the pattern can be adjusted.

Figure 13:
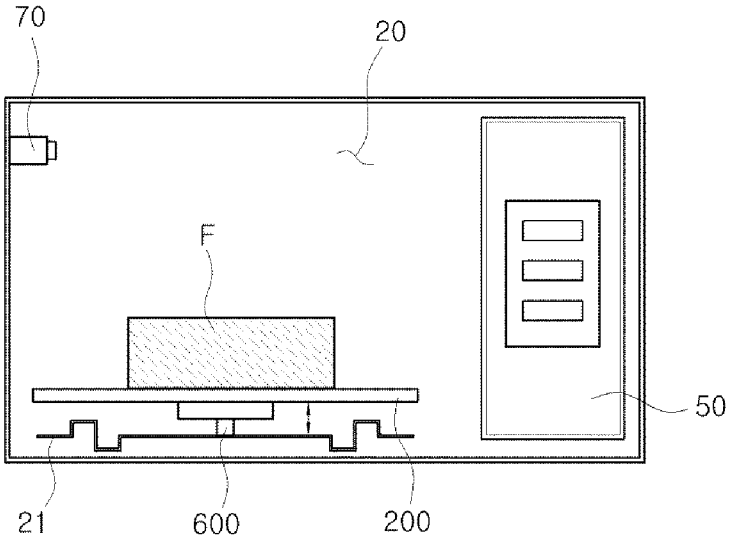
FIG. 13 is a view illustrating how the height of the tray is automatically adjusted in the microwave oven according to the embodiment of the present invention.

FIG. 13 is a view illustrating how the height of the tray is automatically adjusted in the microwave oven according to the embodiment of the present invention. FIG. 13 illustrates a case in which a spring damper 600 is applied as an example.

As illustrated in FIG. 13, the height of the tray 200 may be changed according to the state of the food placed on the tray 200. The state of the food includes a type of the food, a weight of the food, a density of the food, an initial temperature of the food, and so on.

When the weight of the food is small, when the density of the food is low, or when the initial temperature of the food is high, the distance between the bottom surface 21 of the cooking chamber 20 and the tray 200 is increased. That is, the height of the tray 200 is increased. In contrast, when the weight of the food is great, when the density of the food is high, or when the initial temperature of the food is low, the distance between the bottom surface 21 of the cooking chamber 20 and the tray 200 is reduced. That is, the height of the tray 200 is reduced. This is because it takes longer to heat the food when the weight of the food is greater, the density of the food is higher, or the initial temperature of the food is lower. By reducing the distance between the tray 200 and the bottom surface 21 of the cooking chamber 20, the microwave radiation reflected from the bottom surface 21 of the cooking chamber 20 can be more effectively transmitted to the food.

The height of the tray 200 may be automatically adjusted according to the state of the food. At this time, as an example, a spring damper 600 may be used to adjust the height of the tray 200.

At least one of a camera and a sensor capable of measuring the state of the food may be installed in the microwave oven 1. As an example, at least one of the camera and the sensor may be installed in the cooking chamber 20. The sensor may include a temperature detecting sensor, a density detecting sensor, a weight detecting sensor, and so on. FIG. 13 illustrates a case in which a camera 700 is installed in the cooking chamber 20 as an example.

When a user places the food on the tray 200 and operates the microwave oven 1, at least one of the camera and the sensor measures the state of the food. When the measurement of the state of the food is completed, the height of the tray 200 is automatically adjusted according to the result. At this time, not only the height of the tray 200 but also the width, height, depth, etc. of the pattern can be automatically adjusted.

Figure 14:
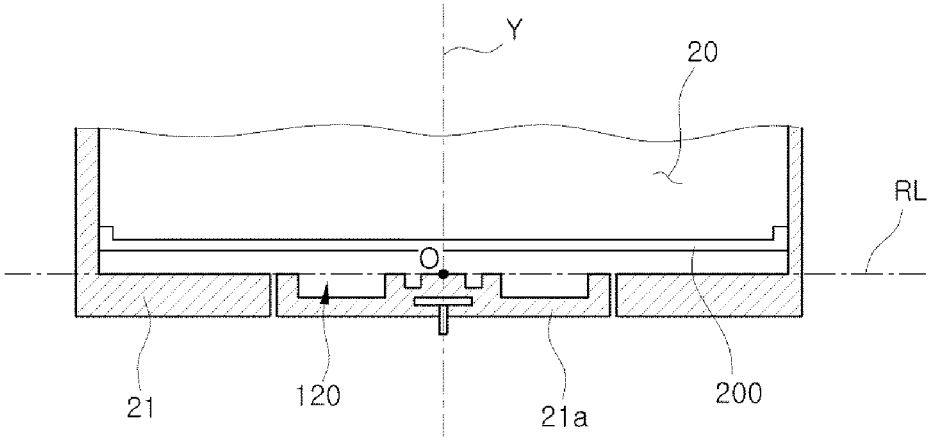
FIG. 14 is a sectional view illustrating a microwave oven according to another embodiment of the present invention.

FIG. 14 is a sectional view illustrating a microwave oven according to another embodiment of the present invention. Hereinafter, repetition of the description of FIGS. 1 to 13 will be omitted.

As illustrated in FIG. 14, a tray 200 may be fixed in a cooking chamber 20. The tray 200 may be formed of an insulating material.

A pattern including at least one of a first reflective portion 110 and a second reflective portion 120 may be formed on a bottom surface 21 of the cooking chamber 20. A part 21*a* of the bottom surface 21 of the cooking chamber 20 may be rotatably installed. To be specific, the part 21*a* of the bottom surface 21 of the cooking chamber 20 may be installed to be rotatable about a vertical axis Y passing through the geometrical center O of the bottom surface 21 of the cooking chamber 20. The pattern including at least one of the first reflective portion 110 and the second reflective portion 120 may be formed at the part 21*a* of the bottom surface 21 of the cooking chamber 20.

Figure 15:
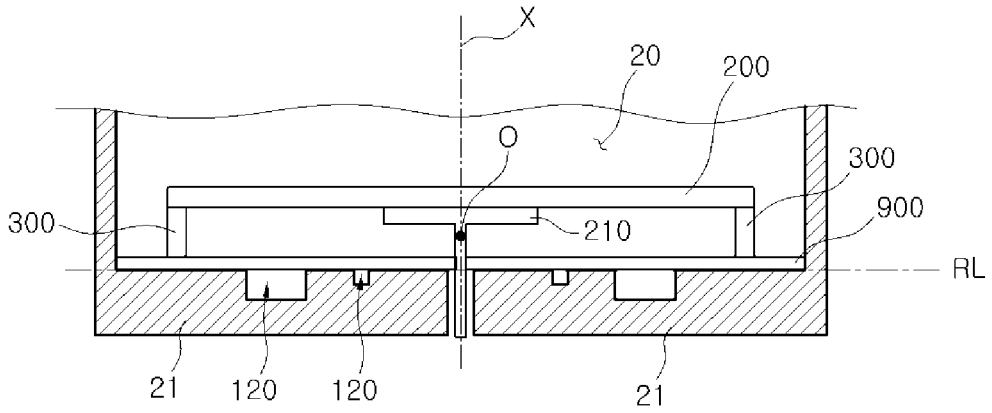
FIG. 15 is a sectional view illustrating the microwave oven according to the other embodiment of the present invention.

FIG. 15 is a sectional view illustrating the microwave oven according to the other embodiment of the present invention. Hereinafter, the repetition of the description of FIGS. 1 to 13 will be omitted.

As illustrated in FIG. 15, the microwave oven 1 may further include a plate 900.

The plate 900 may be formed of a material by which microwave radiation can be transmitted. As an example, the plate 900 may be formed of a glass material.

The plate 900 may be disposed between the tray 200 and at least a part of the bottom surface 21 of the cooking chamber 20. To be specific, the plate 900 may be disposed between the tray 200 and the bottom surface 21 of the cooking chamber 20 on which at least one of the first reflective portion 110 and the second reflective portion 120 is formed.

In another aspect, the plate 900 may be disposed above the bottom surface 21 of the cooking chamber 20. To be specific, the plate 900 may be disposed between the tray 200 and the bottom surface 21 of the cooking chamber 20 on which at least one of the first reflective portion 110 and the second reflective portion 120 is formed.

FIG. 15 illustrates a case in which the plate 900 is disposed on the bottom surface 21 of the cooking chamber 20 on which the second reflective portion 120 is formed as an example. In this case, a plurality of wheels 300 that rotatably support the tray 200 may move on the plate 900.

In this way, the plate 900 is disposed between the tray 200 and the bottom surface 21 of the cooking chamber 20 on which at least one of the first and second reflective portions 110 and 120 is formed. Thereby, it is possible to prevent at least one of the first and second reflective portions 110 and 120 from being contaminated by foreign materials. The foreign materials may include dust, food, and so on.

A plurality of plates 900 may be disposed between the tray 200 and at least the part of the bottom surface 21 of the cooking chamber 20.

Above, the food is an example of an object that can be heated by the microwave radiation.

At least one first reflective portion is formed on the bottom surface of the cooking chamber, thereby allowing the food to be evenly heated by the microwave radiation reflected from the bottom surface of the cooking chamber.

At least one second reflective portion is formed in the bottom surface of the cooking chamber, thereby allowing the food to be evenly heated by the microwave radiation reflected from the bottom surface of the cooking chamber.

The distance between the bottom surface of the cooking chamber and the tray is adjusted according to a type or weight of the food, and thereby a cooking time of the food can be reduced.

At least one of the first reflective portion and the second reflective portion is formed on the bottom surface of the cooking chamber, thereby allowing the food to be evenly heated regardless of the type of the magnetron or a cooking algorithm, for example, a cooking time.

Although specific embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a housing including a cooking chamber having a bottom surface;

a magnetron provided to generate microwave radiation;

at least one first reflective portion formed on the bottom surface of the cooking chamber, the at least one first reflective portion to reflect the microwave radiation;

a tray disposed apart from the bottom surface of the cooking chamber to support food to be heated by the microwave radiation;

a plurality of wheels to rotatably support the tray and to be supported by the bottom surface; and at least one second reflective portion recessed from the bottom surface below the bottom surface, wherein the at least one first reflective portion having a given height protrudes from the bottom surface above a reference level with respect to the bottom surface.

2. The microwave oven according to claim 1, wherein a distance between the tray and a highest point of the at least one first reflective portion is smaller than $\lambda/4$ where $\lambda$ is a minimum wavelength of the microwave radiation.

3. The microwave oven according to claim 2, wherein a height of the at least one first reflective portion is smaller than $\lambda/4$, and a cross-sectional area of the at least one first reflective portion in parallel to the bottom surface of the cooking chamber is smaller than $\lambda/4\times$the height of the at least one first reflective portion.

4. The microwave oven according to claim 1, wherein the at least one first reflective portion is integrally formed with the bottom surface of the cooking chamber.

5. The microwave oven according to claim 1, wherein at least one of a height and a width of the at least one first reflective portion is changed depending on a method of operating the microwave oven according to a weight, a type, and an initial state of the food.

6. The microwave oven according to claim 1, wherein a distance between the tray and the bottom surface of the cooking chamber is changed in correspondence with a weight of the food or according to a manual selection by a user.

7. The microwave oven according to claim 1, wherein the at least one first reflective portion is used as a guide for wheels that support the tray and rotate about a rotational axis of the tray which passes through a geometrical center of the bottom surface of the cooking chamber.

8. The microwave oven according to claim 1, wherein the at least one first reflective portion has a closed loop shape and has a symmetrical structure with respect to a plane including a rotational axis of the tray which passes through a geometrical center of the bottom surface of the cooking chamber.

9. The microwave oven according to claim 1, wherein the at least one first reflective portion has at least one structure selected from among:

of rotational symmetry with respect to a plane including a rotational axis of the tray which passes through a geometrical center of the bottom surface of the cooking chamber, or of mirror symmetry with respect to a plane including a rotational axis of the tray which passes through a geometrical center of the bottom surface of the cooking chamber.

10. The microwave oven according to claim 1, wherein a part of the bottom surface of the cooking chamber including the at least one first reflective portion is provided to be rotatable about a vertical axis passing through a geometrical center of the bottom surface of the cooking chamber.

11. A microwave oven comprising:

a housing including a cooking chamber having a bottom surface;

a magnetron provided to generate microwave radiation;

at least one first reflective portion formed on the bottom surface of the cooking chamber, the at least one first reflective portion to reflect the microwave radiation; and a tray disposed apart from the bottom surface of the cooking chamber to support food to be heated by the microwave radiation, wherein the at least one first reflective portion having a given height extends from the bottom surface above a reference level with respect to the bottom surface, wherein a part of the bottom surface of the cooking chamber including the at least one first reflective portion is provided to be rotatable about a vertical axis passing through a geometrical center of the bottom surface of the cooking chamber, and wherein the food is supported by a non-rotating tray formed of an insulating material.

12. A microwave oven comprising:

a housing including a cooking chamber having a bottom surface;

a magnetron provided to generate microwave radiation;

at least one first reflective portion formed on the bottom surface of the cooking chamber, the at least one first reflective portion to reflect the generated microwave radiation;

a tray disposed apart from the bottom surface of the cooking chamber to support food to be heated by the generated microwave radiation; and a plurality of wheels to rotatably support the tray and to be supported by the bottom surface, wherein the at least one first reflective portion is recessed from the bottom surface at a given depth below a reference level with respect to the bottom surface, wherein at least one of the at least one first reflective portion and the tray are configured to rotate during the generation of the microwave radiation, and wherein a width of the at least one first reflective portion is changed depending on a method of operating the microwave oven according to a weight, a type, and an initial state of the food.

13. The microwave oven according to claim 12, wherein a distance between the tray and a highest point of the bottom surface of the cooking chamber is smaller than $\lambda/4$ where $\lambda$ is a minimum wavelength of the microwave radiation.

14. The microwave oven according to claim 13, wherein a depth of the at least one first reflective portion is smaller than $\lambda/4$, and a cross-sectional area of the at least one first reflective portion in parallel to the bottom surface of the cooking chamber is smaller than $\lambda/4 \times a$ depth of the at least one first reflective portion.

15. The microwave oven according to claim 12, wherein:

the at least one first reflective portion is used as a guide for the plurality of wheels that support the tray and rotate about a rotational axis of the tray which passes through a geometrical center of the bottom surface of the cooking chamber, and the at least one first reflective portion has at least one structure selected from among:

of rotational symmetry with respect to a plane including a rotational axis of the tray which passes through a geometrical center of the bottom surface of the cooking chamber, or of mirror symmetry with respect to a plane including a rotational axis of the tray which passes through a geometrical center of the bottom surface of the cooking chamber.

16. The microwave oven according to claim 12, wherein the at least one first reflective portion has at least one structure selected from among:

of rotational symmetry with respect to a plane including a rotational axis of the tray which passes through a geometrical center of the bottom surface of the cooking chamber, or of mirror symmetry with respect to a plane including a rotational axis of the tray which passes through a geometrical center of the bottom surface of the cooking chamber.

17. The microwave oven according to claim 12, wherein a part of the bottom surface of the cooking chamber including the at least one first reflective portion is provided to be rotatable about a vertical axis passing through a geometrical center of the bottom surface of the cooking chamber.

18. The microwave oven according to claim 12, wherein the food is supported by a non-rotating tray formed of an insulating material.

19. The microwave oven according to claim 12, wherein a distance between the tray and the bottom surface of the cooking chamber is automatically changed in correspondence with a weight of the food or according to a manual selection by a user.

20. The microwave oven according to claim 12, further comprising a plurality of mechanical movers configured to extend and retract from the at least one first reflective portion in a horizontal direction, wherein the width of the at least one first reflective portion is changed by movement of the plurality of mechanical movers in the horizontal direction.

* * * * *